US005123836A

United States Patent [19]

Yoneda et al.

[11] Patent Number: 5,123,836

[45] Date of Patent: Jun. 23, 1992

[54] METHOD FOR THE COMBUSTION TREATMENT OF TOXIC GAS-CONTAINING WASTE GAS

[75] Inventors: Noriyuki Yoneda, Tokyo; Hidehiko Kudoh, Yokohama; Norio Iwamoto, Yokohama; Munekazu Nakamura, Yokohama; Chiaki Kojima, Yokohama; Kunio Kaneko, Yokohama; Yoshifumi Mori, Chiba; Hideto Ishikawa, Yokohama; Hiroji Kawai, Yokohama, all of Japan .

[73] Assignee: Chiyoda Corporation, Japan

[21] Appl. No.: 386,639

[22] Filed: Jul. 31, 1989

[30] Foreign Application Priority Data

| | | | |
|---|---|---|---|
| Jul. 29, 1988 | [JP] | Japan | 63-190050 |
| Sep. 2, 1988 | [JP] | Japan | 63-218389 |
| Sep. 16, 1988 | [JP] | Japan | 63-231787 |
| Oct. 11, 1988 | [JP] | Japan | 63-255614 |
| Nov. 11, 1988 | [JP] | Japan | 63-284930 |
| Jul. 21, 1989 | [JP] | Japan | 1-189351 |

[51] Int. Cl.[5] ..... F23D 14/00; F23G 7/06; C01B 13/20; B01D 47/00

[52] U.S. Cl. ..... 431/5; 423/210; 423/337; 423/DIG. 20; 110/215; 110/216; 110/344

[58] Field of Search ..... 423/337, DIG. 20, 210 E; 55/240; 431/5, 121, 19; 110/216, 215, 344; 261/DIG. 9

[56] References Cited

U.S. PATENT DOCUMENTS

| | | | |
|---|---|---|---|
| 2,224,130 | 12/1940 | Arnold | 431/19 |
| 3,755,990 | 9/1973 | Hardison | 55/240 |
| 3,954,945 | 5/1976 | Lange et al. | 423/337 |
| 4,048,290 | 9/1977 | Lee | 423/336 |
| 4,108,964 | 8/1978 | Kratel et al. | 423/337 |
| 4,276,274 | 5/1981 | Heckel | 423/337 |
| 4,292,290 | 9/1981 | Tunison | 423/336 |
| 4,555,389 | 11/1985 | Soneta et al. | 423/337 |
| 4,801,437 | 1/1989 | Konayaga et al. | 423/337 |
| 4,881,952 | 11/1989 | Masaru | 55/1 |
| 4,908,191 | 3/1990 | Boldish et al. | 423/210 |
| 4,973,451 | 11/1990 | Vickery | 431/5 |

FOREIGN PATENT DOCUMENTS

| | | | |
|---|---|---|---|
| 61-93310 | 5/1986 | Japan | 423/337 |

*Primary Examiner*—Gary P. Straub
*Assistant Examiner*—Peter T. DiMauro
*Attorney, Agent, or Firm*—Lorusso & Loud

[57] ABSTRACT

A method and apparatus for the combustion treatment of a toxic gas which forms microparticles by combustion are disclosed wherein the toxic gas is subjected to a combustion treatment in a specific combustion furnace where the combustion gas formed is brought into contact with an aqueous film flowing downwards on the inner wall of the furnace from the upper end portion thereof to the lower end portion thereof or with a cooled surface, and then optionally with aqueous droplets dispersed in the interior space of the furnace. The water captures the microparticles formed by combustion of the toxic gas and is discharged out of the furnace as a mixed flow with the combustion gas thus treated, and optionally the mixed flow is successively treated in a gas-liquid separator.

22 Claims, 10 Drawing Sheets

METHOD FOR THE COMBUSTION TREATMENT OF TOXIC GAS-CONTAINING WASTE GAS

BACKGROUND OF THE INVENTION

1. Field of the Invention

The present invention relates to a method and apparatus for the combustion treatment of a waste gas containing toxic gas from electronics and semiconductor industries for detoxicating such waste gas. More particularly, the present invention relates to a method and apparatus for the combustion treatment of a waste gas containing a toxic gas which, on combustion, is oxidized to form microparticles. The waste gas is subjected to a combustion treatment in a furnace where the toxic gas is oxidatively burnt and the resultant microparticles are absorbed in an aqueous film or droplets, and is then discharged out of the furnace together with water absorbing the microparticles without permitting the formation of any deposit of the microparticles on the inner wall of the furnace.

2. Description of the Prior Art:

In electronics and semiconductor industries, a waste gas containing gaseous toxic substances represented by arsine ($AsH_3$), phosphine ($PH_3$), diborane ($B_2H_6$), monosilane ($SiH_4$), etc. is formed in the steps for manufacturing semi-conductors. Since such waste gas is highly toxic to humans, complete elimination of such toxic substances contained in the waste gas is necessary prior to exhaust of the waste gas to atmosphere.

Various methods are known for effectively eliminating or detoxicating such toxic substances, such as a combustion method and an adsorption method. Among these methods, the adsorption method is easy in operation and thus employed conventionally to detoxicate the waste gas, adsorbed onto an adsorbent so that the waste gas thus treated can safely be exhausted from the production system. In this adsorption method, however, the used adsorbent contains the toxic substances and so has to be brought to a complicated secondary treatemnt for detoxicating it. Further, a lot of replacement or activation of the adsorbent are required during the operation. Accordingly, this adsorption method necessitates further treatment and replacements of adsorbent and so cannot be said to be economically suitable.

On the other hand, the combustion method contemplates oxidative decomposition of the toxic substances in the waste gas under combustion conditions whereby the gaseous toxic substances are oxidatively converted into solid microparticle in the form of oxides and can be removed from the gaseous substances. Such combustion method is known, for example, in Japanese Laid-open Patent Appln. Nos. Sho. 62-134414 and 62-152517. As no replacements are needed for the combustion method, in case of mass treatment of waste gas, the combustion method is superior.

Among the gaseous toxic substances, for example, arsine is oxidatively converted according to such a combustion method into arsenic oxide ($As_2O_3$, $As_2O_5$), phosphine into phosphorus pentoxide ($P_2O_5$), and silane into silicon oxides ($SiO$, $SiO_2$). The majority of these oxidized solid substances are also toxic and have to be eliminated completely from the combustion gas prior to exhaust to atmosphere. As these solid substances are formed in gaseous phase decomposition, the size of these particles is in the order of sub-micron, unlike ordinary particles of several microns which are, for example, contained in smoke dusts. Accordingly, it is extremely difficult to remove these microparticles completely from the combustion gas unlike the removal of larger particles. In the prior art combustion methods as mentioned above, air is used as a combustion-supporting gas for burning the toxic gas and a stream of air is blown into the combustion furnace along the wall thereof in order to protect the surface of the inner wall from deposit of such microparticles, simultaneously with forming an air flow of a high linear velocity towards an exit of the furnace to entrain the formed microparticles in the exhaust gas to be discharged out of the combustion furnace. The exhaust gas from the furnace is then introduced into a wet-type dust-removing apparatus installed outside the furnace where the microparticles are captured and separated from the combustion gas which can now be exhausted safely.

However, there are a number of drawbacks to be overcome also in such an air combustion method. As the waste gas has to be treated in two steps with a combustion furnace and a wet-type dust-removing apparatus, such a method is not efficient in operation and needs a large space for installation. Further, the removal rate of solid microparticles in the conventional wet-type dust-removing apparatus is inherently not so high. As the solid microparticles are captured outside the combustion furnace, the microparticles have to be discharged entirely out of the furnace together with the exhaust gas. However, it is extremely difficult to discharge the microparticles entirely from the furnace since they tend to deposit on the inner wall of the combustion furnace. In the prior art methods, therefore, it is proposed that a stream of air having a relatively high linear velocity is compulsorily formed in the furnace towards an exit thereof to prevent deposit of the microparticles on the inner wall of the furnace. The formation of a stream of air having such a high linear velocity is not only economically disadvantageous but still unsatisfactory to protect the inner wall completely from deposit of the microparticles. Thus, a small amount of the microparticles is permitted to deposit on the inner wall even in case of using a stream of air having a very high linear velocity. The amount of the microparticles deposited on the inner wall becomes larger evenly or locally with the lapse of time. Accordingly, a large amount of the deposit built up on the inner wall will eventually be dropped as a lump irregularly from time to time from the inner wall, and as a result of this phenomenon, the operating conditions of the combustion furnace, especially the pressure condition for combustion significantly fluctuate to the extent of preventing complete combustion of the toxic gas. What is more, deposit of the microparticles on the inner wall causes corrosion of the furnace.

In such air combustion methods, the extent of the flame stably existing in the furnace is extremely narrow relative to the flow rate of the waste gas so that the burner of the furnace tends to be blown off particularly in case the linear velocity of the air stream is increased with an attempt to enhance the effect of discharging the microparticles out of furnace. This phenomenon becomes significant especially in case of the combustion of arsine, phosphine or the like gas which is poor to form a flame on combustion, thus risking that the toxic gas will be discharged without being burnt or decomposed. If toxic gas still remains undecomposed in the exhaust gas from the combustion furnace, a secondary treatment such as an adsorption treatment becomes necessary to eliminate the toxic gas completely. As the volume of the exhaust gas is increased by using a stream of air having a high linear velocity, a large size dust-removing apparatus will be necessary to deal with the exhaust gas. When the oxidation in the combustion furnace is complete, the resultant microparticles consist of highly oxidized substances such as $As_2O_5$, $P_2O_5$ and $SiO_2$. In case the oxidation in the combustion furnace is incomplete for the reasons as described above, however, the resultant microparticles will include partially oxidized or pyrolyzed substances. For example, the combustion treatment of $AsH_3$ permits the formation of $As_2O_3$ and As in addition to $As_2O_5$. Likewise, the combustion treatment of $PH_3$ also permits the formation of $P_2O_3$ and P, and the combustion treatment of $SiH_4$ also permits the formation of Si and SiO which is highly self-ignitable. These partially oxidized or pyrolyzed substances are insoluble or sparingly soluble in water and so are hardly removed from the exhaust gas by a wet-type dust-removing apparatus. Furthermore, self-ignitable substances such as SiO are hazardous which makes their handling difficult.

In the above mentioned prior art methods, the microparticles are discharged out of the furnace together with the combustion gas and then introduced into a wet-type dust-removing apparatus or an air-liquid separator for eliminating the microparticles. In this case, the wet-type dust-removing apparatus has a dual function of removing the microparticles and cooling the combustion gas and is generally selected from a spray tower, a packed bed and a venturi scrubber.

Thus, the prior art methods involve a number of problems to be solved, especially in complete elimination of the gaseous toxic substances by combustion and in prevention of the inner wall of the furnace from deposit of the microparticles. Accordingly, there is still a great demand to develop new method and apparatus for the combustion treatment of gaseous toxic substances wherein the various drawbacks found in the prior art methods are overcome.

SUMMARY OF THE INVENTION

It is an object of the present invention to provide a method for the combustion treatment of a toxic gas wherein various drawbacks in the prior art methods are wholly overcome.

It is another object of the present invention to provide a method for the combustion treatment of a toxic gas wherein the combustion treatment is carried out under specific conditions in a furnace whereby the toxic gas is completely decomposed and oxidized to form microparticles which are then absorbed completely in a downwardly flowing aqueous film and aqueous droplets to prevent deposit of the microparticles on the inner wall of the furnace.

It is still another object of the present invention to provide a method for the combustion treatment of a toxic gas wherein the combustion treatment is carried out under specific conditions in a furnace whereby the microparticles are cooled together with the combustion gas and absorbed in aqueous droplets formed by condensation or externally sprayed to prevent deposit of the microparticles on the inner wall of the furnace.

It is further object of the present invention to provide an apparatus for the combustion treatment of a toxic gas which comprises a furnace provided with a diffusion-type burner and a means for forming a downwardly flowing aqueous film on the inner surface thereof together with a means for forming aqueous droplets.

It is yet a further object of the present invention to provide an apparatus for the combustion treatment of a toxic gas which comprises a furnace provided with a diffusion-type burner and a cooled surface together with a means for forming aqueous droplets.

It is still further object of the present invention to use a buffering space for the furnace to adjust the pressure in the furnace for complete combustion of the toxic gas.

In the preparation of semiconductors, it is generally necessary to minimize pressure variation in the production line in order to accomplish suitable crystal growth. When a waste gas exhausted from the production line is subjected to a combustion treatment, a variation of combustion pressure is likely to be caused in the whole system. Thus, a buffering space is suitably used for minimizing the pressure variation in the combustion device.

Other and further objects, features and advantages of the present invention will be apparent more fully from the following description.

It has now been found that an effective combustion of the toxic gas and entire removal of the resultant microparticles from the furnace can be attained by conducting the combustion treatment in a furnace provided with a diffusion-type burner, a means for forming a downwardly flowing aqueous film on the inner wall or a means for forming a cooling surface inside, and a means for forming aqueous droplets, whereby the microparticles can be absorbed in the aqueous film and aqueous droplets and discharged from the furnace entirely to substantially prevent the inner surface from deposit of the microparticles.

In accordance with one embodiment of the present invention, there is provided a method for the combustion treatment of a toxic gas which forms microparticles by combustion, which comprises subjecting the toxic gas to a combustion treatment in a combustion furnace where an aqueous film flows downwards on the inner wall of the furnace from the upper end portion thereof to the lower end portion thereof whereby microparticles formed by combustion of the toxic gas are captured with the downwardly flowing aqueous film and discharged out of the furnace.

According to a variant of the above embodiment, the method comprises subjecting the toxic gas to a combustion treatment wherein the toxic gas is introduced simultaneously with a combustion-supporting gas having an oxygen content of at least 60 vol % into a combustion furnace where a diffusion-type burner is mounted downwardly from the ceiling portion thereof, and burned while adjusting the total amount of non-inflammable gas in the furnace to less than 4 volumetric parts per volumetric part of the toxic gas introduced, bringing the resultant combustion gases into contact with a solid cooling surface to condense steam contained in the combustion gases while spraying aqueous droplets into the combustion gases whereby microparticles formed by combustion of the toxic gas are captured and absorbed in the dropelts and wherein the gases in the combustion furnace are allowed to flow towards an exit of the furance at a linear velocity less than 0.05 meter/sec.

According to another variant of the above embodiment, the method comprises subjecting the toxic gas to a combustion treatment in a combustion furnace where an aqueous film flows downwards on the inner wall of the furnace from the upper end portion thereof to the lower end portion thereof, while bringing the resultant combustion gas into contact with aqueous droplets whereby microparticles formed by combustion of the toxic gas are captured with the downwardly flowing aqueous film and the aqueous droplets, discharging water with absorbed the microparticles and the combustion gases out of the furnace and introducing the water and the gases into a gas-liquid separator directly connected to the bottom of the furnace to effect separation of the water from the combustion gases.

According to still another variant of the above embodiment, the method comprises subjecting the toxic gas to a combustion treatment in a combustion furnace with the arrangement such that the combustion furnace is connected through a backfire preventing device to a first valve of a pipe for supplying the toxic gas and a conventional adsorption bed tower is connected to a second valve of the pipe, and the toxic gas is normally supplied to the combustion furnace by opening the first valve while keeping the second valvel closed, but a conventional adsorption treatment of the toxic gas is carried out by opening the second valve while keeping the first valve closed only in the case of any abnormal increase in the pressure across the toxic gas supplied system, any extinguishment of the flame in the combustion furnace or any detection of an inflammable gas in the combustion gases discharged.

According to further variant of the embodiment, the method compriese subjecting the toxic gas to the combustion treatment in a manner as described above wherein the inner pressure of the furnace is balanced with the pressure of an external space kept under a constant pressure through a buffer connected to the combustion furnace and surrounded by a flexible material to isolate the inner space from the external space, and the inner volume of the buffer is changed to absorb variation in pressure of the gases in the combustion furnace.

In accordance with another embodiment of the present invention, there is provided an apparatus for the combustion treatment of a toxic gas which forms microparticles by combustion, which apparatus comprises an upright combustion furnace provided with a diffusion-type burner including an inlet for the toxic gas, and a water-supplying device for the formation of an aqueous film flowing downwards on the innner wall of the furnace.

According to a variant of the second embodiment, the apparatus comprises an upright combustion furnace and a gas-liquid separator directly connected to the bottom of the combustion furnace, characterized in that the combustion furnace is provided with a diffusion-type burner in a ceiling portion thereof, a water jet nozzle capable of jetting water in the circumferential direction of the furnace in the upper end portion thereof, and a water spray nozzle beneath the water jet nozzle and in that the gas-liquid separator is provided on the upper portion thereof with a gas-exhaust pipe and at the bottom thereof with a water drain pipe.

Accordingly to another variant of the second embodiment, the apparatus comprises an upright combustion furnace provided with a diffusion type burner including an inlet for the toxic gas, a water-supplying device capable of spraying aqueous droplets into the inner space of the combustion furnace, and an exit for gases and water, the combustion furnace being constructed to have a jacket-type structure through which a cooling medium is passed to give a solid cooling surface on the inner wall thereof, with an arrangement such that the diffusion-type burner is mounted in the ceiling portion of the furnace, the exit is formed on the bottom thereof, and the water-supplying device is connected to the lower portion thereof.

According to still another variant of the second embodiment, the apparatus comprises the combustion furnace connected through a backfire-preventing device to a valve of a pipe for supplying the toxic gas and provided with a pressure sensor interposed between the furnace and the pipe and capable of detecting abnormal increase in pressure of the toxic gas, a flame-detecting sensor capable of detecting any extinguishment of the flame of the burner, a gas sensor positioned near the exit of the furnace and capable of detecting the existence of an inflammable gas in the gases discharged out the furnace, and a control unit capable of closing the valve of the pipe.

According to further variant of the second embodiment, the apparatus comprises the combustion furnace of the types as above mentioned which is provided with a buffer connected to combustion furnace and surrounded by a flexible material isolating the inner space from the external space kept under a constant pressure, the volume of the buffer space being changeable to absorb variation in pressure of the gases in the furnace.

The present invention is featured by providing an upright combustion furnace with a means for forming an aqueous film which flows downwards on the inner wall of the furnace from the upper end portion thereof to the lower end portion thereof and into the inner space of the furnace for absorbing the microparticles in the aqueous film. The present invention also provides for supplying a toxic gas and a combustion-supporting gas necessary for achieving the combustion treatment of the toxic gas under specific conditions whereby the proportion of oxygen in the combustion-supporting gas and the linear velocity of the gases in the furnace towards an exit thereof are properly controlled to attain complete oxidative decompositon of the toxic gas. The present invention also provides for providing the combustion furnace, if necessary, with a gas-liquid separator for removing the microparticles from the combustion gas and a buffer space for balancing the inner pressure of the furnace with the pressure of an external space kept under a constant pressure.

The toxic gas as an object to be treated in the present invention forms solid microparticles by combustion. Illustrative of such toxic gas 4 are, for example, compounds of the elements belonging to Groups III-V of the Periodic Table which are gaseous at ordinary temperature, such as arsine, phosphine, diborane, selenium hydride, monosilane, chlorosilane, trimethyl gallium, trimetlyl indium and trimethyl aluminum. Such toxic gas is involved in a waste gas from the steps of chemical reactions for manufacturing semi-condutors, photofibers and the like new industrial materials. The content of the toxic gas in such a waste gas is 0.001–50% in terms of volumetric percentage, the balance being hydrogen, nitrogen, argon and the like gases according to the sort of waste gases. By the term "toxic gas" is meant herein various waste gases comprised of the above mentioned toxic gas alone or in mixture with other non-toxic gases. If the content of combustible gas is low in a waste gas to be treated so that the waste gas as a whole is sparingly combustible and difficult to form a flame, an easily combustible gas such as hydrogen or methane may be incorporated into the waste gas to improve combustibility. In this case, a mixture of the waste gas and the combustible gas can be regarded as a waste gas to be treated.

In the present invention, a combustion-supporting gas is used for the combustion treatment to burn the waste gas efficiently. Accordingly, the combustion-supporting gas preferably has a high content of oxygen. Usually, an oxygen-enriched gas or pure oxygen having an oxygen content of 60–100 vol% is used as the combustion-supporting gas in this invention according to the sort of the waste gas used. Thus, the term "combustion-supporting gas" is used herein to mean an oxygen-containing gas having an oxygen content sufficient enough to burn the waste gas completely. In general, the use of a combustion-supporting gas having a higher oxygen content, e.g. at least 60 vol% is preferable, especially for preventing the flame from any "blown-off" phenomenon and for converting the gaseous toxic substances into microparticles of a highly oxidized form which are easily removable from the combustion gas in a scrubber. Further, the use of the combustion-supporting gas of a higher oxygen content serves to reduce the amount of nitrogen in the combustion gas so that the total volume of the combustion gas discharged out of the combustion furnace can effectively be reduced to make the subsequent after-treatment advantageous.

When the gasesous toxic substance is subjected to a combustion treatment, the substance is oxidatively decomposed in gaseous phase to form solid microparticles. For example, arsine is converted by combustion into oxides there ($As_2O_3$, $As_2O_5$), phosphine into phosphorus pentoxide, diborane into boron oxide ($B_2O_3$), and silane into oxides thereof (SiO, $SiO_2$). In this invention, such microparticles are captured with and absorbed in an aquesous film flowing downwards on the inner wall of the furnace from the upper end portion thereof to the lower end portion thereof and with aqueous droplets sprayed into the furnace.

In practice of the present invention, the gases in the furnace are generally allowed to flow from the burner towards an exit of the furnace. The velocity of the gases towards the exit is desirably so adjusted that the linear velocity of the gases may become less than 1 meter/sec, preferably less than 0.05 meter/sec, more preferably less than 0.01 meter/sec. At such a low linear velocity in the furnace, the residence time of the microparticles become so long that they can be brought into contact with the aqueous film flowing on the inner wall of the furnace and/or with aqueous droplets floating therein for a sufficient period of time whereby the microparticles are entirely absorbed in water and removed efficiently from the combustion gas. In case the burner is mounted downwardly from the ceiling portion of the furnace, the microparticles are floated in a mixed turbulent flow of the downwardly flowing combustion gas and the convection heat current in upward direction from the flame whereby the frequency of contact of the microparticles with the aqueous film and/or droplets is increased to enhance the capturing efficiency.

In addition to the combustible gas and the combustion-supporting gas, various gases are introduced into the combustion furnace. Such gases include, for example, a combustible curtain gas for the purpose of preventing the burner from clogging, air for ventilating the furnace, and a gas, e.g. air used for spraying water and incorporated into the aqueous spray. Except for the combustible gas, including the waste gas and the curtain gas, the combustion-supporting gas (oxygen which may contain nitrogen, etc.) and the air for ventilation and spraying are defined herein with the terminology of "non-combustible gas".

In the present invention, it is desirable to adjust the volume of the total non-combustible gases to less than 4 volumetric parts, preferably less than 1.5 volumetric parts per volumetric part of the waste gas. This requirement can easily be attained by using an oxygen-enriched combustion-supporting gas whereby the volumetric amount of nitrogen which is utterly unnecessary for the combustion reaction can correspondingly be decreased to minimized the volume of the gases in the furnace. Further, this requriement brings about a number of merits mentioned above with respect to the use of the combustion-supporting gas having a high oxygen content.

BRIEF DESCRIPTION OF THE DRAWINGS

The present invention can more fully be understod from the following description taken in conjuction with the accompanying drawings in which.

DETAILED DESCRIPTION OF THE INVENTION

Figure 1:
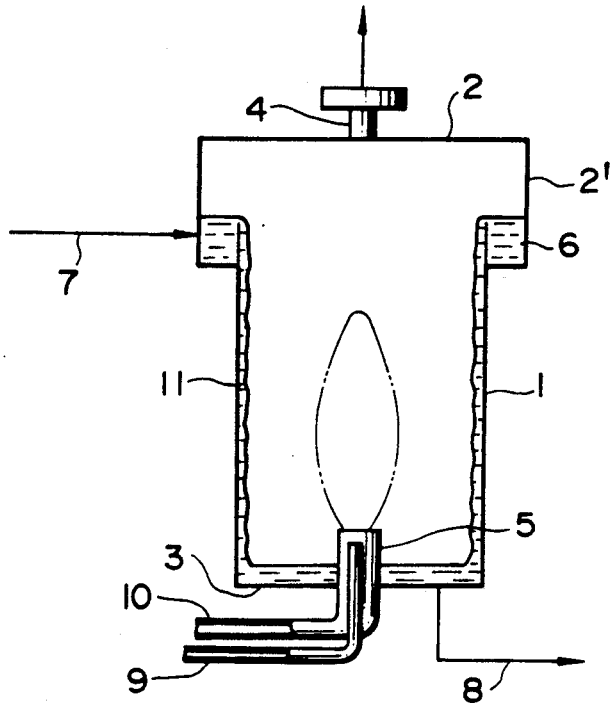
FIG. 1 is a longitudinal cross sectio of one example of the apparatus of this invention wherein a combustion burner is mounted to extend upwardly from the bottom of the combustion furnace.

In FIG. 1 showing an example of the basic model of the apparatus in practice of this invention, the apparatus comprises an upright combustion furnace 1 in the form of a hollow cylindrical body where the upper end and the lower end thereof are closed with a lid 2 and a bottom plate 3 to form a ceiling portion 2 and the bottom portion 3. In the ceiling portion 2, an exhaust pipe 4 for discharging the combustion gas is mounted to the furnace 1 and the bottom portion 3 is equipped with a combustion burner 5 comprised of a pipe 9 for a waste gas containing the toxic gas and a pipe 10 for the combustion-supporting gas. Thus, a flame is formed upwardly from the bottom portion.

The lid forming the ceiling portion 2 is provided around its periphery with a depending cylindrical wall 2' having a diameter somewhat large than that of the furnace body 1. The lower part of the cylindrical wall 2' is bent inwardly and connected at its lower end to the outer surface of the furnace body 1 to form an annular space 6 between the inner surface of the cylindrical wall 2' and the outer surface of the upper end portion of the furnace body 1. The cylindrical wall 2' is provided with a pipe 7 through which water is supplied to the annular space 6. The water in the annular space 6 then overflows the upper end of the furnace body 1 to form an aqueous film 11 on the inner surface of the furnace body 1. The bottom 3 is provided with a pipe 8 through which water is taken out.

Figure 2:
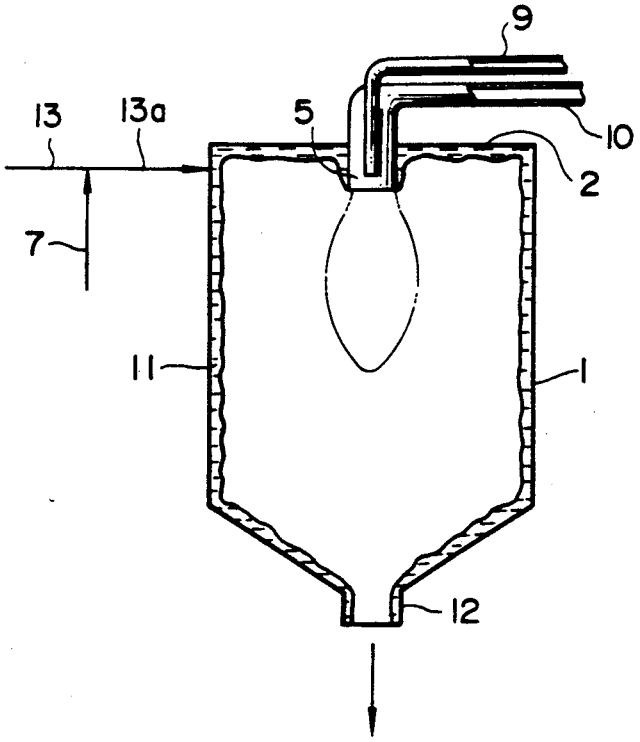
FIG. 2 is a longitudinal cross section of a similar example of the apparatus of this invention wherein a combustion burner extends from the ceiling portion of the combustion furnace.
Figure 3A:
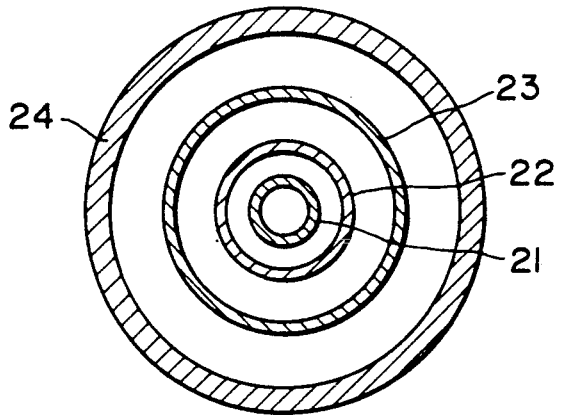
FIGS. 3(*a*)–(*f*) are respective cross sectional views of the front end portions of various embodiments of the combustion burner.
Figure 3B:
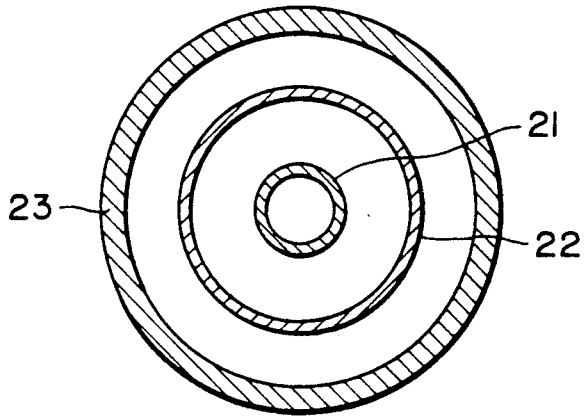
Figure 3C:
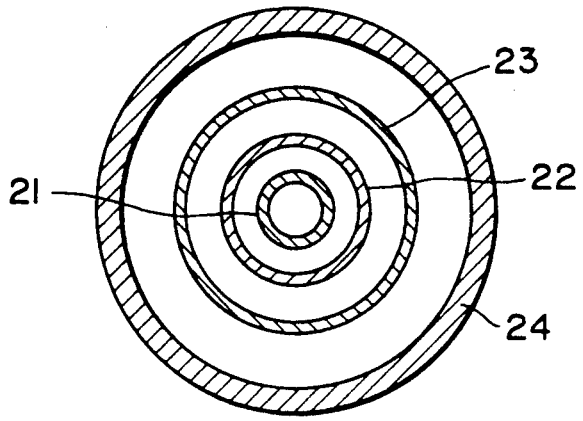
Figure 3D:
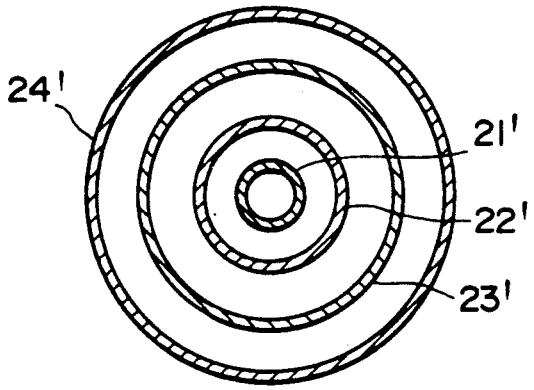
Figure 3E:
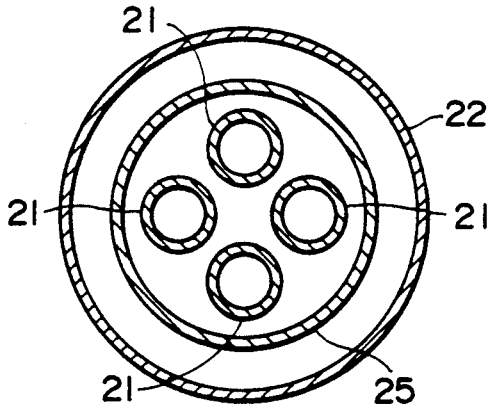
Figure 3F:
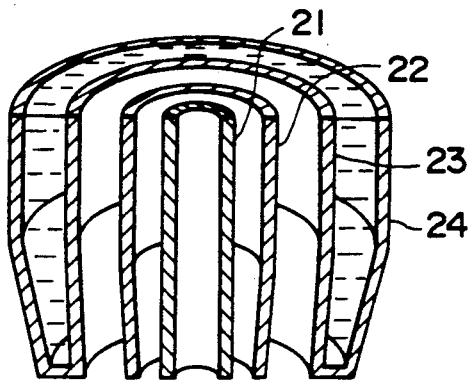

In FIG. 2 showing another example of the basic model of the apparatus of this invention, the burner 5 comprised of the pipe 9 for the waste gas and the pipe 10 for the combustion-supporting gas as in FIG. 1 is fitted to the ceiling portion 2 of the furnace body 1 so that a flame may be formed downwardly. In the case of such a downward flame, the flame can be concentrated so that the toxic gas can be burnt completely at a high temperature and the combustion space can be reduced. An opening is formed at the bottom of the furnace body 1, which is used as an exit 12 for the combustion gas and the water forming the aqueous film. The furnace body is equipped at the upper end thereof with jet nozzles 13*a* as a water-supplying device tangential to the circumference of the furnace. The structure of the jet nozzles may be similar to those shown in FIG. 8. A jet stream of water in the inner circumferential direction (tangential direction) of the furnace can be formed by either sending water compressed by a pump to jet nozzles or mixing water from the pipe 7 with compressed air from a pipe 13 and injecting the mixed flow into the furnace. Air is usually used for the purpose of pressurizing water.

The formation of the aqueous film 11 without using a pressurizing pump according to the means as shown in FIG. 1 is suitable in case of the upright furnace standing vertically. According to the means as shown in FIG. 2, however, the aqueous film 11 can be formed irrespective of whether the furnace is slanted or not. By increasing the velocity of the jet stream of water in the means as shown in FIG. 2 due to elevation of the pump pressure, the amount of water for forming the aqueous film can be minimized and the aqueous film can also be formed on the outer periphery of the burner fitted to the ceiling portion. The formation of the aqueous film on the outer periphery of the burner is preferable in that the microparticles attached onto the outer periphery of the burner can be captured with the aqueous film and any corrosion or clogging of the burner with the microparticles can be prevented. Regardless of the position of the burner shown in FIG. 1 or 2, a water-cooling jacket (not shown) may be mounted around the outer periphery of the burner whereby the temperature of the burner is allowed to drop to prevent evaporation of water from the aqueous film formed on the outer periphery of the burner. Accordingly, the aqueous film can be formed on the outer periphery of the burner with a smaller amount of water.

Preferable as the burner used in the apparatus of this invention is a diffusion-type burner wherein the waste gas is mixed at the front end thereof with the combustion-supporting gas. A premixing-type burner wherein the waste gas is premixed with the combustion-supporting gas before entering in the furnace is not preferable as the burner used in this invention because the waste gas is reacted, if it contains a reactive toxic gas, with the combustion-supporting gas in the nozzle to form solid matter which tends to clog the nozzle. The diffusion-type burner has a fundamental structure such that a path for a stream of the waste gas and a path for a stream of the combustion-supporting gas exist independently, optionally together with a path for a stream of a combustible gas and a path for a stream of an inert gas, and a water-cooling jacket exists in the outermost portion. In case a path for a stream of a combustible gas is interposed between the path for a stream of the waste gas and the path for a stream of the combustion-supporting gas, any diffusive mixing of the waste gas with the combustion-supporting gas just after coming out of the burner can be avoided to protect the front end portion of the burner from deposit of the microparticles. In case of this structure, the combustion-supporting gas is entirely consumed by the combustible gas at the front end of the burner and is not diffused up to the waste gas so that the reaction between the waste gas and the combustion-supporting gas at the tip of the burner can be prevented. The use of an inert gas such as nitrogen in place of the combustible gas can also prevent any diffusive mixing of the waste gas with the combustion-supporting gas at the tip of the burner. In this case, however, the reaction between the waste gas and the combustion-supporting gas at the tip of the burner cannot perfectly be avoided so that deposit of the microparticles on the front end portion of the burner cannot satisfactorily be prevented especially in case of the waste gas being maintained at a high temperature or alternatively the combustion treatment being carried out for a long period of time. Further, the combustion efficiency become poor in this case. Thus, the combustion gas and the inert gas are properly selected according to the combustion condition to prevent mixing of the waste gas with the combustion-supporting gas in the front end portion of the burner.

The structure of various models of the diffusion-type burner is shown in FIGS. 3(*a*)–(*f*).

FIG. 3(*a*) shows a cross-sectional view of an example of the burner used in this invention, which has a structure of a coaxial quadruple tube. A first pipe 21 is positioned in the central part of the tube and forms a nozzle for the waste gas containing the gaseous toxic substances. A second pipe 22 positioned outside the first pipe forms a nozzle for a primary combustion-supporting gas. A third pipe 23 positioned outside the second pipe forms a nozzle for a secondary combustion-supporting gas. A fourth pipe 24 positioned outside the third pipe has a closed front end and forms a cooling jacket.

FIG. 3(*b*) shows a cross sectional view of another example of the burner used in this invention, which has a structure of a coaxial triple tube. A first pipe 21 is positioned in the central part of the tube and forms a nozzle for the waste gas. A second pipe 22 positioned outside the first pipe forms a nozzle for the combustion-supporting gas. A third pipe 23 positioned outside the second pipe is closed at the front end to form a cooling jacket.

FIG. 3(*c*) shows a cross sectional view of still another example of the burner used in this invention, which has a structure of another coaxial quadruple tube. A first pipe 21 positioned in the central part of the tube forms a nozzle for the waste gas. A second pipe 22 positioned outside the first pipe forms a nozzle for the combustible gas. A third pipe 23 positioned outside the second pipe forms a nozzle for the combustion-supporting gas. A fourth pipe 24 positioned outside the third pipe is closed at the front end to form a cooling jacket.

FIG. 3(*d*) is a cross-sectional view of a further example of the burner used in this invention, which has a structure of still another coaxial quadruple tube. A first pipe 21' positioned in the central part of the tube forms a nozzle for the combustible gas. A pipe 22' positioned outside the first pipe forms a nozzle for the waste gas. A pipe 23' positioned outside the second pipe forms a nozzle for the combustible gas. A fourth pipe 24' positioned outside the third pipe forms a nozzle for the combustion-supporting gas.

FIG. 3(*e*) shows a cross sectional view of a still further example of the burner used in this invention, which has a structure such that plural small pipes (4 small pipes in the drawing) are arranged inside a coaxial double tube. The plural small pipes 21 existing in the central part of the tube respectively form nozzles for the waste gas. A pipe 25 surrounding the small pipes forms a nozzle for the combustible gas, and a pipe 22 positioned outside the pipe 25 forms a nozzle for the combustion-supporting gas.

FIG. 3(*f*) is a perspective view showing the longitudinal cross section of a burner similar to that shown in FIG. 3(*a*) having a structure squeezed at the front end thereof. A pipe 21 positioned in the central part of the tube forms a nozzle for the waste gas. A pipe 22 positioned outside the pipe 21 forms a nozzle for a primary combustion-supporting gas. A pipe 23 positioned outside the pipe 22 forms a nozzle for a secondary combustion-supporting gas. An outermost pipe 24 is joined at the front end thereof to the pipe 23 to form a cooling jacket wherein a cooling medium, e.g. a cold water is introduced. In the burner of this type wherein the front end thereof has a squeezed structure, a flame is concentrated so that the combustion of the waste gas is stable and a good combustion efficiency is achieved.

Figure 4:
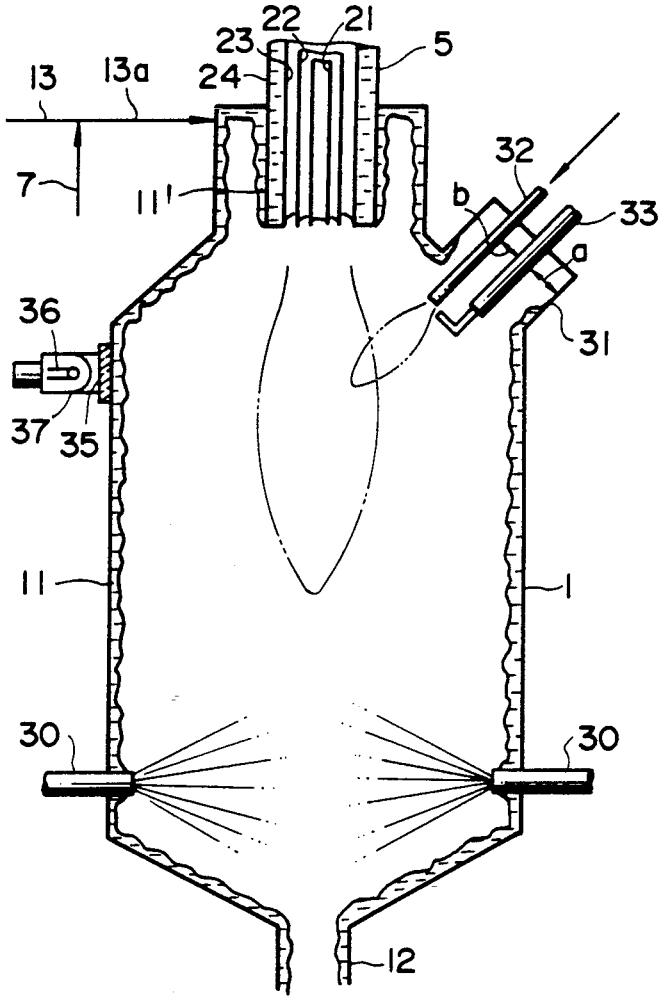
FIG. 4 is a longitudinal cross section of another practical example of the apparatus of this invention wherein the furnace is provided with a pilot burner and a spary nozzle.

FIG. 4 is a longitudinal cross section showing another example of the apparatus used in practice of this invention. This apparatus is a variant of the basic model as shown in FIG. 2. This apparatus comprises a combustion furnace having a cylindrical body 1 provided on the wall in the lower portion thereof with a spray nozzle 30 capable of spraying aqueous droplets into the interior space of the furnace. As in the case of the apparatus shown in FIG. 2, the cylindrical body 1 is provided with a burner 5, an exit 12 and a water-supplying device comprised of a pipe 7 and a pipe 13 for the formation of an aqueous film 11 which flows downwards on the inner wall of the furnace while rotating thereon in tangential direction to the cylindrical body standing upright. This effect is attained by the action of compressed air supplied from the pipe 13. The burner shown in FIG. 4 is similar to the model shown in FIG. 3(*a*) wherein the outermost pipe 24 is joined (closed) at its front end to the pipe 23 to form a cooling jacket which is filled with a cooling medium such as cold water. The aqueous droplets sprayed from the spray nozzle 30 come into collision with the combustion gas in the interior space of the furnace whereby the combustion gas is rapidly cooled with the aqueous droplets and the microparticles formed by combustion of the toxic gas and contained in the combustion gas are absorbed in the aqueous droplets and also in the aqueous film. More precisely, steam contained in the combustion gas is condensed by cooling to form aqueous droplets having the microparticles as nuclei whereby the microparticles are incorporated into the self-formed aqueous droplets and removed from the combustion gas in addition to the mode of removal of the microparticles with the aqueous film and the sprayed aqueous droplets. Thus, removal of the microparticles contained in the combustion gas can be efficiently attained.

Figure 5:
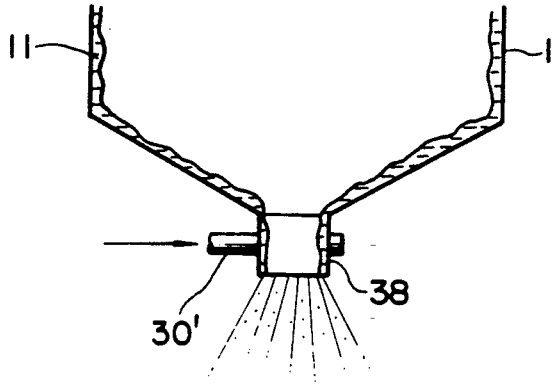
FIG. 5 is a partial longitudinal cross section of an example of the apparatus of this invention similar to that shown in FIG. 4, wherein a venturi scrubber is mounted in the bottom of the furnace in place of the spray nozzle.

FIG. 5 shows a modification in the lower portion of the apparatus shown in FIG. 4, wherein a venturi scrubber 38 is mounted in the exit in place of the spray nozzle 30 in the wall of the furnace body 1. In this case, pressurized water is sprayed from a tube 30' and the fine aqueous droplets or mist thus formed are allowed to come into collision with the microparticles contained in the combustion gas whereby they are captured with the droplets and removed from the combustion gas.

In the apparatus shown in FIG. 4, the furnace body 1 is further provided with a pilot burner 32 and a UV-detecting device 36,37. A part of the wall in the upper portion of the furnace body 1 projects outwards to form a recess wall 31 where the pilot burner 32 is mounted together with an ignition plug 33 the outer peripheral surface of which is covered with an insulator. The pilot burner 32 and the ignition plug 33 are positioned in such manner that the distance a between the surface of the insulator and the surface of the recessed wall and the distance b between the surface of the insulator and the outer surface of the pilot burner may be set at an interval of about several millimeters. The sparking discharge portion at the front end of the ignition plug is preferably in a hook form as shown in FIG. 4. Such an arrangement serves not only to prevent the pilot burner 32 and the ignition plug 33 from contact with the aqueous film flowing on the inner wall of the furnace but also to avoid any short circuit between the pilot burner and the ignition plug and any sparking in a place other than the ignition plug. Moreover, the surface of the front end of the pilot burner and the ignition plug are wetted with drips from the aqueous film positioned above the pilot burner and the ignition plug to protect the pilot burner and the ignition plug from deposit of the microparticles. When the microparticles deposit on the front end portion of the pilot burner and the ignition plug, various troubles occur, including difficulty in ignition of the burner. However, the arrangement of the pilot burner and the ignition plug in the above mentioned manner can prevent such troubles so that ignition of the burner can be attained with certainty. The insulator of the ignition plug may be so modified that the insulator can be dried with a gas such as air introduced thereinto as a ventilating gas. Hydrogen is preferably used as a combustible gas for the pilot burner. Since hydrogen has a wide combustion range with respect to the mixing ratio and linear velocity as compared with a combustible gas such as methane or ethane, the use of hydrogen offers the advantage that the size of the pilot burner can be minimized and a "blow-off" phenomenon of the flame does not occur even if the linear velocity of the gases in the furnace is increased.

The apparatus shown in FIG. 4 is furthermore provided with a watching device. An opening is formed in the upper portion of the furnace body 1 and sealed with a looking glass 35. A UV-detecting device is mounted behind the looking glass, which is constructed with a UV-detecting tube 36 and a supporting tube 37 therefor. The UV-detecting device is set aside the wall opposite the flame of the pilot burner to check whether the flame of the pilot burner is formed or not. The use of this device serves to secure complete and stable combustion of the toxic gas and to prevent any leakage of the toxic gas remaining unburned out of the furnace. As the looking glass is at all times washed with the flowing aqueous film during the operation, deposit of the microparticles on the looking glass is completely prevented to keep high visibility therethrough, thus making it possible to detect existence or absence of the flame.

Below is a detailed explanation on the practice of this invention, using the apparatus shown in FIG. 4.

At the outset, hydrogen is burned with air at the pilot burner to form a hydrogen flame. Next, water is sprayed from the spray nozzle 30 into the interior space of the furnace to form aqueous droplets. Water from the pipe 7 is pressurized with compressed air from the pipe 13 and a mixture of water and air is jetted into the interior space in the circumferential (tangential) direction to the furnace to form an aqueous film 11 which flows downwards on the inner wall of the furnace by gravity. In this case, an aqueous film 11 may also be formed on the ceiling portion of the furnace by somewhat slanting the direction of the jet stream upwards. An aqueous film 11' may also be formed on the outer peripheral surface of the burner by the aqueous film flowing from the ceiling portion.

Water is then supplied to the outermost fourth pipe 24 closed at the front end to form a water-cooling jacket, while the waste gas containing the toxic gas is supplied to the first (or innermost) pipe 21, oxygen (as the primary combustion-supporting gas) to the second pipe 22 and oxygen (as the secondary combustion-supporting gas) to the third pipe 23. These gases are then allowed to flow out of the burner and are burned by the hydrogen flame from the pilot burner. The microparticles formed by combustion of the toxic gas in the manner described above are captured with the aqueous film formed on the inner wall of the furnace. The microparticles are also captured with the aqueous droplets sprayed from the spray nozzle 30. The waste gas is entirely burned in this manner and the resultant microparticles are completely captured with and absorbed in the aqueous film and the aqueous droplets. The water absorbing the microparticles is discharged out of the furnace from the exit 12 formed at the bottom thereof together with the combustion gas. The water used for the formation of the aqueous film and droplets is collected and subjected to a liquid-solid separation treatment. Water from which the microparticles have completely been removed may be discarded or recycled for repeated use. In case the water is recycled, it is collected at the exit 12 and recycled directly or after separation of the microparticles by precipitation. As the particle size of the microparticles is extremely small (in the order of submicron), they are homogeneously dispersed in water and there is no fear of deposit on the inner wall in case of such repeated use.

On combustion of the toxic gas, the hydrogen component contained therein is oxidized to form water. Thus, the combustion gas contains a relatively large proportion of water as steam. In case the combustion gas is rapidly cooled, for example, by bringing it into contact with a cooling surface, steam contained therein is condensed to form aqueous droplets or an aqueous thin film on the cooling surface whereby the microparticles concurrently formed are absorbed in the aqueous droplets or thin film. In this manner, water and the microparticles can be separated from the combustion gas and moreover the microparticles can be absorbed in the self-produced aqueous droplets and a thin aqueous film formed on the cooling surface. Such cooling surface may be formed in the interior space of the furnace or in the inner wall thereof. As the amount of water used for capturing the microparticles in this mode is smaller than in the mode shown in FIG. 1 or 2, it is preferable to use spray nozzles capable of spraying aqueous droplets into ther interior space of the furnace to attain complete capture of the microparticles with the aqueous droplets.

Figure 6:
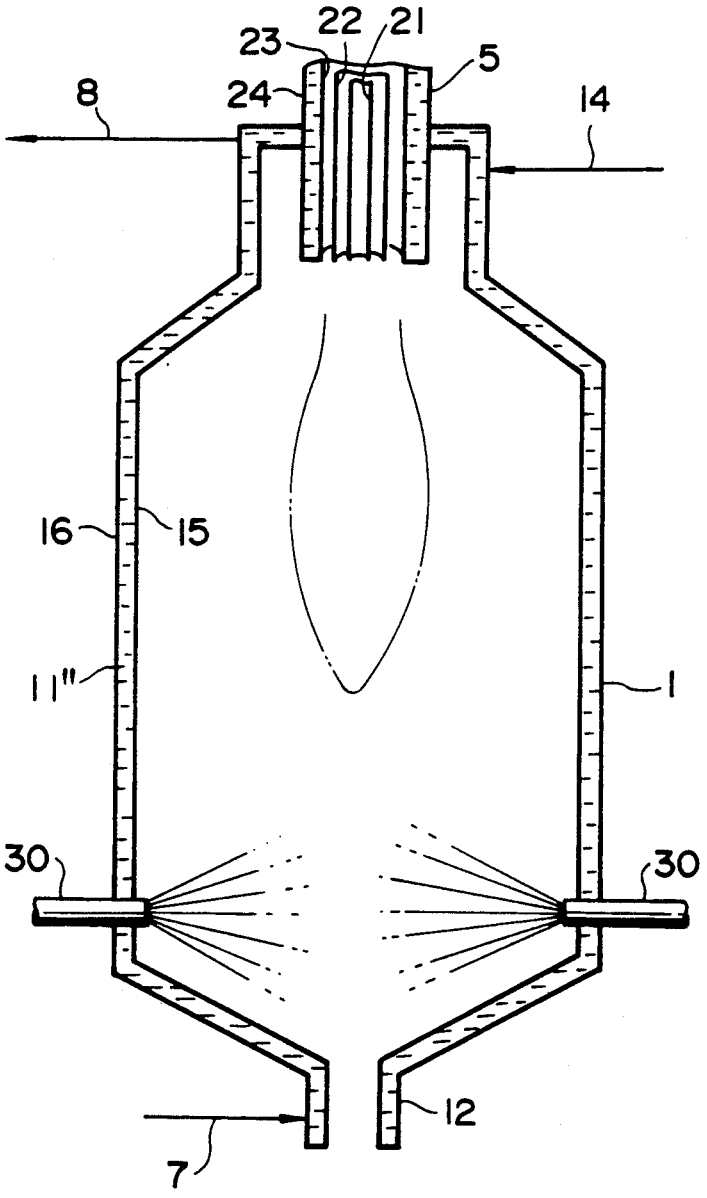
FIG. 6 is a longitudinal cross section of still another example of the apparatus of this invention wherein the combustion furnace has a wall with a water jacket through which a cooling medium is passed to afford a cooling surface.

In FIG. 6 showing still another example of the apparatus used in this invention, the cooling surface is formed on the inner surface of the furnace. In FIG. 6, the reference numerals 1, 5, 7, 8, 12, 13, 21–24 and 30 show the same parts as given in FIGS. 1–5. Thus, the apparatus shown in FIG. 6 is similar to that shown in FIG. 4 except that the apparatus shown in FIG. 6 is devoid of (1) a recess for mounting a set of the pilot burner and the ignition plug and (2) a looking glass through which the combustion condition can be monitored with a UV-detecting device. If necessary, however, the apparatus shown in FIG. 6 may of course be provided with the above (1) and (2), as in the case of FIG. 4.

The furnace body 1 of the apparatus shown in FIG. 6 has a double wall structure with a jacket-like function. Accordingly, the wall of the furnace is comprised of an inner wall 15 and an outer wall 16 and has a hollow space 11'' between both walls. The hollow space 11'' is filled with a cooling medium such as chilled water introduced through a pipe 7 in the lower end portion of the furnace and discharged through a pipe 8 at the upper end portion thereof whereby the inner wall 15 forms a cooling surface for the combustion gas. A burner 5 suspended from the top of the furnace body 1 may have a similar structure as that shown in FIG. 4 and is operated similarly. For example, chilled water is supplied to the outermost fourth pipe 24 forming a water-cooling jacket, while the waste gas to be treated is supplied to the innermost first pipe 21, oxygen as the primary combustion-supporting gas to the second pipe 22 and oxygen as the secondary combustion-supporting gas to the third pipe 23. On the other hand, water is supplied to the spray nozzle 30 and sprayed as aqueous droplets into the interior space of the furnace. The gases are allowed to flow out of the burner and are then burned for oxidative decomposition of the waste gas. In this case, the combustion treatment can conveniently be carried out by the aid of a pilot burner (not shown) and a flame-detecting device (not shown). The resultant combustion gas containing the microparticles is then contacted with the inner wall 15 functioning as a cooling surface where the steam contained in the gas is condensed as aqueous droplets which wet the inner wall as a thin aqueous film. The microparticles contained in the combustion gas are captured with the droplets and the thin aqueous film. The combustion gas is allowed to flow down towards an exit 12 and is passed, on the way to the exit, through a spray zone containing aqueous droplets from the spray nozzle 30 where any remaining microparticles in the combustion gas are entirely captured with the aqueous droplets. The combustion gas free of the microparticles and the water absorbing the microparticles are discharged out of the furnace through the exit 12. In this case, a controlled stream of air may be allowed to flow out as a guide gas from the pipe 14 towards the exit 12. The linear velocity of the gases towards the exit 12 is desirably adjusted to less than 1 meter/sec, preferably less than 0.05 meter/sec, and more preferably less than 0.01 meter/sec whereby the residence time of the combustion gas in the furnace becomes longer and the microparticles contained therein are entirely captured with the aqueous droplets as mentioned above. The concentration of oxygen in the combustion-supporting gas is preferably more than 60 vol % and the volume of the total non-combustible gases is also preferably adjusted to less than 4 volumetric parts per volumetric part of the waste gas, as mentioned above, to obtain the maximum result. Despite using the spray nozzle 30, a venturi scrubber may also be provided at the exit 12 as shown in FIG. 5. A similar result can also be obtained by this modification. The spray nozzle 30 and the venturi scrubber 38 are preferably mounted in the lower portion of the furnace, as shown in FIGS. 4–6, to minimize the influence of aqueous droplets on the burner 5 usually mounted in the ceiling portion of the furnace. The cooling surface may be formed in the interior space of the furnace, for example, by installing a heat-exchanger such as a cooling coil or the like inside the furnace. However, the use of the wall of the furnace as cooling surface is preferred, particularly in that the interior space can be used fully for combustion and collision with aqueous droplets.

Figure 7:
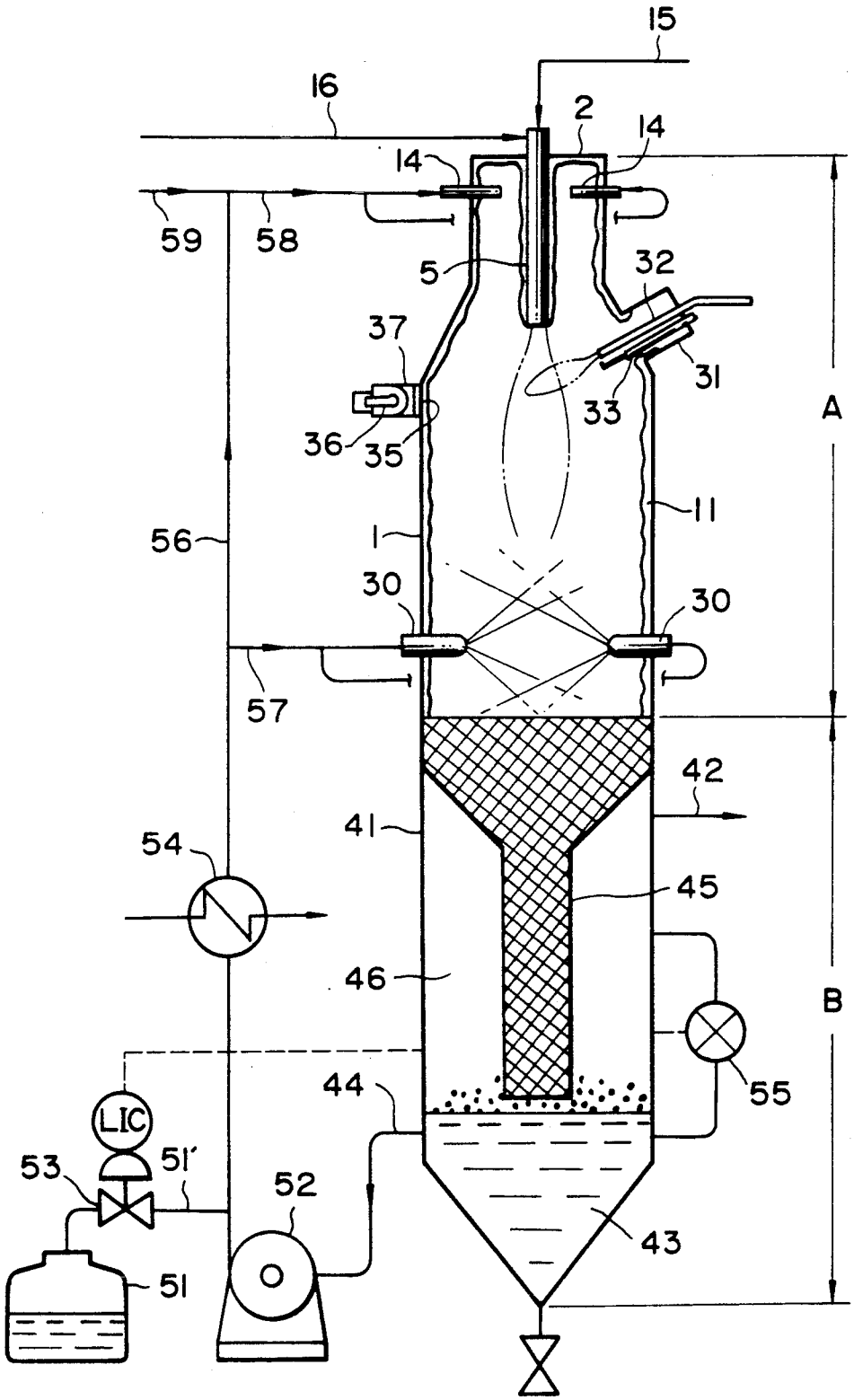
FIG. 7 is an explanatory diagram showing a further example of the apparatus of this invention wherein the combustion furnace is directly connected to a gas-liquid separator.

In FIG. 7, showing a further example of the apparatus used in this invention, the apparatus includes (A) a combustion furnace and (B) a gas-liquid separator. These Parts (A) and (B) are combined to form a single upright column-type apparatus. In FIG. 7, the upper half portion A constitutes a combustion furnace similar to the apparatus shown in FIG. 4 and the lower half portion B constitutes a conventional gas-liquid separator which is directly connected to the portion A at the bottom thereof. The combustion furnace (A) is quite similar to that shown in FIG. 4 except that the former is cut just above the lower squeezed position and connected to the gas-liquid separator (B) and that the former has additional spray nozzles 14 in the upper end portion just below the lid 2. The reference numerals 1, 2, 5, 11, 30–33 and 35–37 used in FIG. 7 show the same parts as shown in FIGS. 2 and 4. Any one of the burners shown in FIG. 3(*a*)–(*f*) can be used as the burner 5 extending downwards from the top lid 2, to which the waste gas is supplied through the pipe 15 and the combustion-supporting gas is supplied through the pipe 16. The combustion treatment of the waste gas in the furnace (A) can be carried out in the same manner and under the same conditions as described hereinbefore with respect to the operation using the apparatus shown in FIG. 4.

The gas-liquid separator (B) directly connected to the lower end portion of the furnace (A) comprises a column body 41 provided at the upper portion thereof with an exhaust pipe 42 for the combustion gas, at the bottom thereof with a liquid pool 43 having a water drain pipe 44, and in the interior space thereof with a packing-filled bed 45. This separator (B) may be any one of the conventional gas-liquid separators so far as it can separate the water absorbing the microparticles from the combustion gas. As the water can be brought into satisfactory contact with the gas in such packing-filled bed, the use of the bed is preferable in the event the combustion gas from the furnace (A) still contains the microparticles. In this case, the microparticles in the gas are captured with the water in the packing-filled bed to make the gas completely free of any microparticles. In case of using the apparatus shown in FIG. 7, therefore, it may not be necessary to make complete elimination of the microparticles in the furnace (A), thus offering the advantage that the amount of water used in the furnace (A) can be minimized to make not only the operation conditions significantly milder but the size of the furnace smaller. No limitation exists for the structure of the packing-filled bed 45 so far as it can attain good gas-liquid contact. For example, the bed 45 may have the structure as shown in FIG. 7 wherein the bed 45 is formed in the upper end portion of the separator (B) and a space 46 and the liquid pool 43 may be formed in the middle and lower end portion thereof, with the proviso that the exhaust pipe 42 communicates with exists the space 46 exists while the water drain pipe communicates with the bottom of the column body where the liquid pool 43 exists. More precisely, the bed 45 is in the form of an upside-down circular truncated cone which is a structure good for satisfactory contact of the gas with water flowing down from the furnace (A) as an aqueous film 11 flowing down on the inner wall of the furnace and as aqueous droplets dropping from the interior space thereof. The bottom of the bed is somewhat stretched downwards to form a pillar of the bed with the annular space 46 surrounding it and the liquid pool 43 beneath the pillar. The bed in such form is preferable for practice of this invention. Any remaining microparticles in the gas are sufficiently contacted with water in the bed whereby they are entirely absorbed in the water.

Any packing material generally used for gas-liquid contact, such as Raschig rings, porcelain balls, etc. can be used for the bed 45. It is preferable in the present invention to use a packing material designed for efficiently conducting gas-liquid contact, such as one used for ordinary fractionator, for example, pieces of wire mesh of 10–100 mesh in size. It is also preferable to use the wire mesh in the form of a cylinder or saddle. When a mixed flow of the gas and the water is allowed to pass downwards through the packed bed of such wire mesh, the water disperses evenly on the surface of the mesh to form an aqueous film through which the gas is passed, whereby good contact occurs between the gas and the water and simultaneously a number of fine bubbles are formed. In these bubbles, the gas moves violently according to the energy of movement of the gas in the bubbles and is brought into good contact with the aqueous film confining the gas. In this manner, the microparticles in the combustion gas can effectively be absorbed in the aqueous phase and removed from the gas. In the column body 41, the gas-fluid separation may be carried out in such manner that the combustion gas and the water from the furnace (A) are collected through a collecting pipe having an upside-down conical form and the collected gas-liquid mixture is bubbled into the liquid pool 26 where the gas-liquid contact is effected and the gas free of the microparticles is separated from the water.

In this case, a mixed flow of the gas and the water passing through the pillar exits from the bottom thereof and comes into collision with water in the liquid pool 43 whereby the gas is efficiently separated from the water. Further, very fine bubbles 47 are formed at the time of downflow of the gas-water mixture through the packed bed and float to the surface of the liquid pool 43, whereby an effective contact is made between the gas in the bubbles and the aqueous film of the bubbles due to the frequent movement of the gas in the bubbles, and as a result of this phenomenon, any remaining microparticles in the gas can efficiently be absorbed in the water. Besides the bed 45, it is also possible to form another packing-filled bed in a part or all of the spaced 46 and to supply it with water for repeating the gas-water contact. The rate of capturing the microparticles with water can be enhanced by such treatment.

Using the apparatus shown in FIG. 7, the combustion treatment is carried out basically in the same manner as described with respect to the appartus shown in FIG. 4. Prior to initiating the treatment, the liquid pool 43 is filled with water. The water is allowed to pass through the water drain pipe 44, a pump 52, pipes 56 and 58 and jetted together with compressed air from a pipe 59 into the furnace through the jet nozzles 14. Besides this, the water is allowed to pass through a pipe 57 and sprayed into the furnace through the spray nozzle 30 positioned in the lower part thereof.

Figure 8:
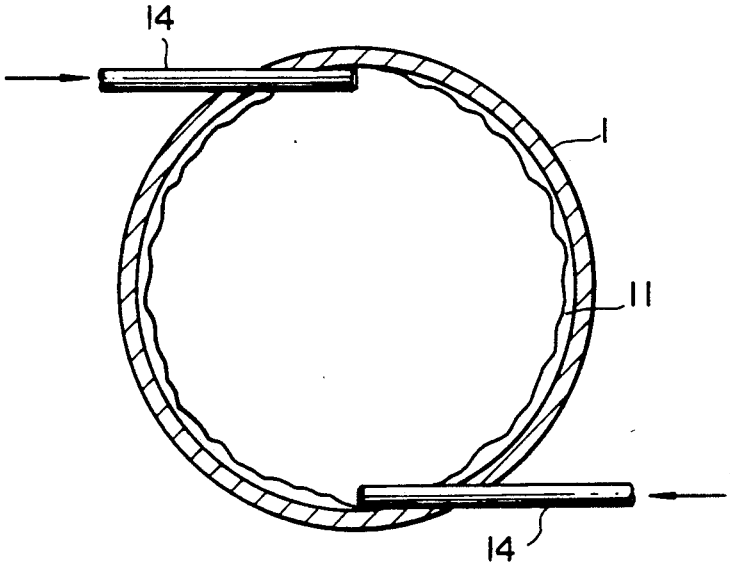
FIG. 8 is a cross sectional view of the combustion furnace shown in FIG. 7 where the furnace is equipped with a pair of jet nozzles.

FIG. 8 is a cross-sectional view of one example of the jet nozzles 14 which consists of a pair of nozzles mounted in the wall of the furnace, which are arranged in diametrically oposite positions towards the circumference of the furnace (or in tangential direction). An aqueous film 11 is formed on the inner surface of the furnace 1 by jetting water from the nozzles 14. The nozzles may slightly be slanted in vertical direction whereby the aqueous film can be formed on the inner wall higher than the position of the nozzles, e.g. on the ceiling portion of the furnace. Accordingly, the aqueous film 11 can also be formed on the outer surface of the burner 5 extending downwards from the ceiling 2.

The waste gas and the combustion-supporting gas are supplied to the burner 5 through the pipes 15 and 16, respectively, and combustion of the waste gas is carried out in the same manner as in the case of the apparatus shown in FIG. 4 by the aid of the pilot burner 32. The aqueous film and droplets absorbing microparticles and the combustion gas discharged from the furnace (A) are mixed in the upper part of the packing-filled bed 45 and the mixed gas-water stream is then allowed to flow down in the bed and to exit from the lower end of the bed as a gas-water mixed flow including bubbles. The mixed flow then contacts the surface of water in the liquid pool 43 where the gas is separated from water and discharged out of the system through the spaced 46 and the exhaust pipe 42. The water in the liquid pool 43 is recycled to the furnace A through the water drain pipe 44, the pump 52, and the pipe 56. Prior to recycling the water, it is cooled in a cooler 54 to a given temperature (about 30° C.). The level of the liquid pool 43 is maintained constant by the aid of a level meter 55 and a level-adjusting valve 53 equipped to the pipe 51' connected to a waste water tank 51. Since water is formed in the combustion treatment of the toxic gas, this water constitutes an excess water in the system. This excess water is allowed to pass through the pipe 51' and pooled in a tank 51 by the aid of the level meter 55 and the level-adjusting valve 53.

It is also preferable in case of using the apparatus shown in FIG. 7 to adjust the linear velocity of the gases in the furnace, the content of oxygen in the combustion-supporting gas and the volumetric ratio of the non-combustible gas to the toxic gas to the recommended values as mentioned above.

As the waste gas to be treated includes a highly toxic gaseous substance such as arsine, it is necessary to make the exhaust gas and the effluent from the industrial plants perfectly free from such toxic gas. If the flame of the burner is extinguished by accident during the combustion treatment, the exhaust gas will contain untreated toxic gas and inflammable gas and so the release of such exhaust gas will causes serious social problems for physilogical reasons and significant environmental pollution. The apparatus for treating such toxic substances must be furnished with effective countermeasures to deal with such problems just in case of accident. In the conventional apparatus for combustion treatments, however, a satisfactory countermeasure has not yet been established to deal with any problem caused by accident. Now widely adopted as a countermeasure in case of accident is dilution of the toxic and inflammable waste gas with a large amount of air or nitrogen before releasing from the apparatus. Thus, there is a great demand to develop a new system of treatments wherein toxic and inflammable gas can continuously be treated even in case of an unexpected accident occurring in the apparatus.

According to a modification of the present invention, the combustion furnace is connected through a back-fire-preventing device and a switching valve to an adsorption bed tower so that the toxic and inflammable gas can removed by an adsorption treatment even if an accident occurs in the combustion furnace and combustion of the toxic and inflammable gas cannot be effected.

In this modification, any of the combustion furnaces as shown by FIGS. 1, 2, 4, 6 and 7 can be used. Further, any type of the adsorption bed towers now conventionally used can be employed for the modification of this invention as far as an adsorbent used therein exhibits good performance in adsorption of the toxic gas to be treated in the present invention.

Various known conventional adsorbents, for example, those containing oxides of heavy metals such as copper, iron, nickel, zinc, etc., such as those disclosed in Japanese Laid-Open Patent Appln. Nos. Sho. 60-68034, 61-90726, 61-129026, 61-209030, 62-1439 and 62-152515 are suitably employed in this invention.

According to this modification, the detoxicating treatment of the toxic waste gas is normally carried out by the combustion treatment using any of the combustion apparatus shown in FIGS. 1, 2, 4, 6 and 7, and the detoxicating treatment is carried out by using an adsorption bed tower only in case of emergency in the combustion apparatus, such as abnormal increase in the pressure of the toxic gas, extinguishment of the flame or detection of inflammable gas in the combustion gas discharged. Thus, the toxic gas in normally supplied to the combustion apparatus through a switching valve and a backfire-preventing device. In case of emergency in the combustion apparatus, the toxic gas in then supplied to the adsorption bed tower by actuating the switching valve. Since there may be a danger of backfire in the system on switching the valve, the use of a backfire-preventing device is required in the pipe for supplying the toxic gas between the furnace and the valve. In the past, various backfire-preventing devices have been proposed, including one having a water-sealed structure and one using a wire net or a porous material. These conventional devices can be used for this invention, though the use of a new type backfire-preventing device newly developed by the present inventors is advantageous for the present invention.

Figure 9:
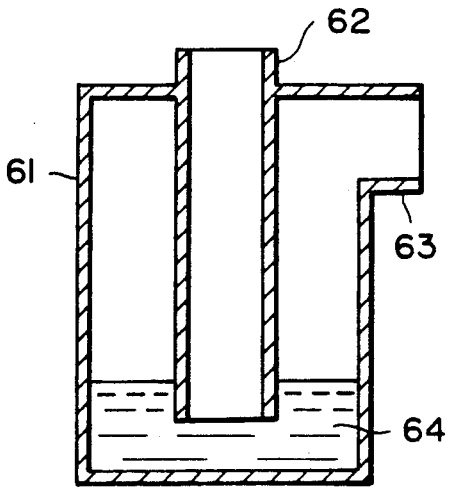
FIG. 9 is a longitudinal cross section of a backfire-preventing device.

FIG. 9 shows a preferred example of the new type backfire preventing device advantageously utilizable for the present invention. In FIG. 9, the device has a main body 61 closed at the upper and lower ends thereof and provided on the top thereof with an inlet 62 for the waste gas and in the upper portion thereof with an outlet 63 for the waste gas. The lower end of the inlet 62 extends nearly to the bottom of the main body 1, and a non-combustible oil 64 is then placed in the main body 1 up to a level capable of sealing the inlet 62. In normal state, the waste gas enters the backfire-preventing device 61 through the inlet 62, bubbles through the non-combustible oil 64, exits the device 61 through the outlet 63, and then enters the combustion furnace (not shown). If backfire occurs in the furnace, propagation of the flame will stop at the surface of the non-combustible oil 64 and will not proceed beyond the inlet 62. If the pressure in the outlet 63 is elevated by backfire, the inner pressure of the device 61 will also be elevated, to push up the level of the oil 64 whereby the inlet will be filled with the oil 64 to shut the path of backfire.

Figure 10:
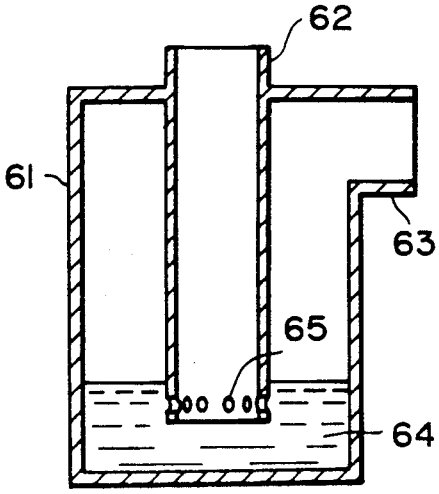
FIG. 10 is a longitudinal cross section of a modified example of the backfire-preventing device shown in FIG. 9.

FIG. 10 shows another preferred example of the new type backfire-preventing device which is a modification of the device shown in FIG. 9. In FIG. 10, the reference numerals used shown the same parts as shown in FIG. 9. In this example, bubbling holes 65 are formed at the lower end portion of the inlet 62 extending near the bottom of the body 61, but the other structure is same as that of the example shown in FIG. 9. In this example, bubbles can be made smaller in size so that the evolution of mists and significant variation in pressure by bubbling can substantially be prevented. The flame of the burner can be stabilized by minimizing variation in pressure by bubbling.

Figure 11:
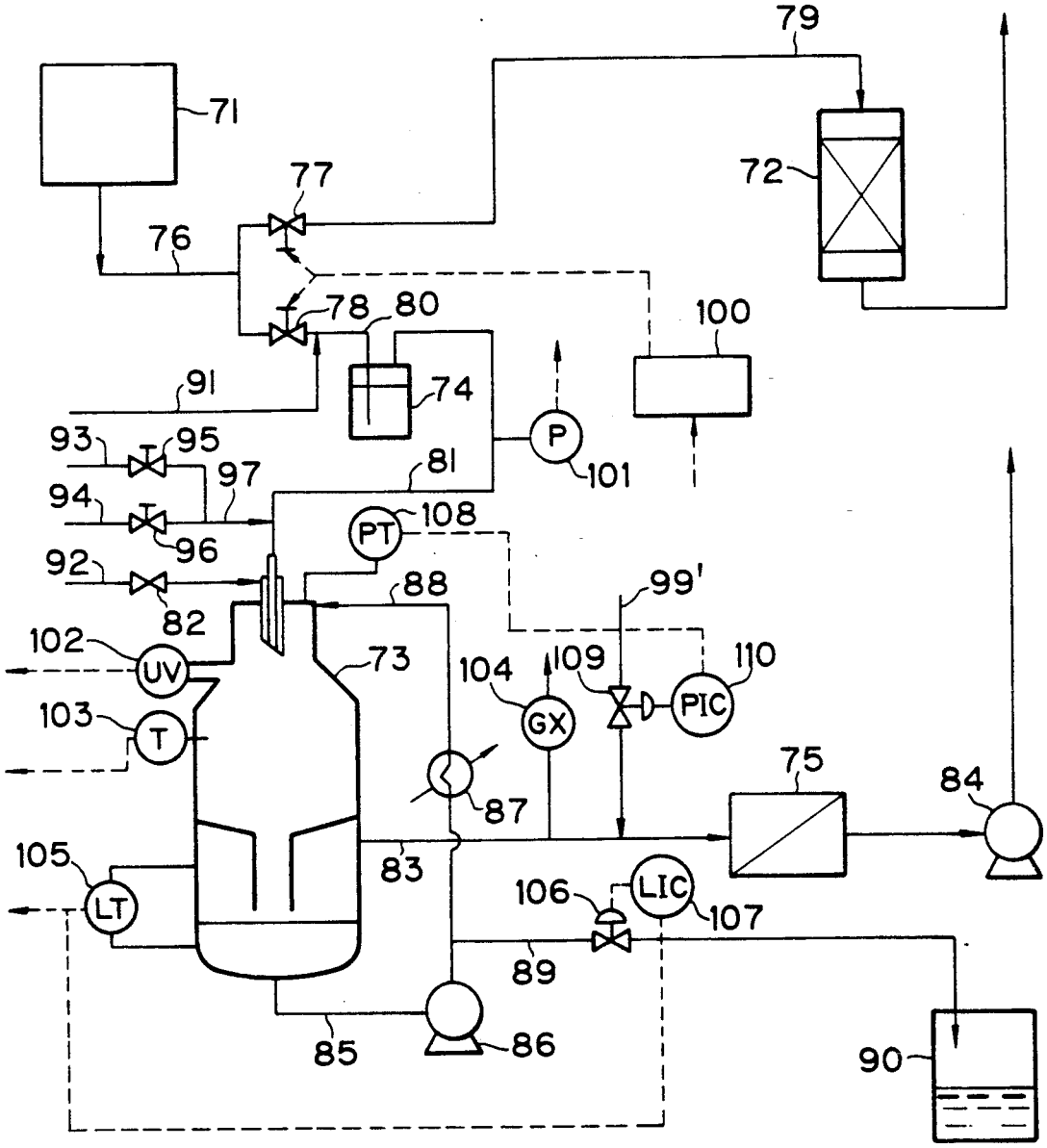
FIG. 11 is a systematic diagram showing the apparatus in practice of this invention to which an adsorbing apparatus is connected.

FIG. 11 is a systematic diagram showing the apparatus used in this invention wherein the apparatus shown in FIG. 7 is combined with an adsorption bed tower. In FIG. 11, the apparatus comprises a source of the toxic gas 71 such as a plant for manufacturing semiconductors, an adsorption bed tower 72, a combustion apparatus 73, a backfire-preventing device 74 and a dust-removing filter 75. A pipe line 76 for supplying the toxic gas from the source 71 is branched in front of a pair of valves 77 and 78 into two pipes lines; one pipe line 79 extending to the tower 72 and the other pipe line 80 to the combustion apparatus 73 via the backfire-preventing device 74. In normal state the valve 77 for the tower 72 is closed and the valve 78 for the combustion apparatus is opened. The toxic waste gas from the source 71 is allowed to pass through the pipe line 76, the valve 78, a pipe line 80, the backfire-preventing device 74 and a pipe line 81 and supplied to a burner 82 where the gas is burned. The combustion gas is brought into contact with an aqueous film flowing on the inner wall of the furnace and with aqueous droplets floating in the interior spaced of the furnace and then allowed to pass through a gas-liquid separator (integrally combined with the furnace in this drawing) where the gas is separated from water containing the microparticles formed by combustion of the toxic gas. The gas thus treated is then allowed to pass through a pipe line 83, the dust-removing filter 75 and an exhaust pump 84 and released. On the other hand, the water is recycled to the combustion apparatus 73 through a pipe line 85, a liquid circulation pump 86, a cooler 87 and then a pipe line 88. A part of the water is allowed to pass through a pipe line 89 and pooled in a waste liquid drum 90.

If necessary, a combustible gas an mentioned hereinbefore such as hydrogen or methane is introduced through a pipe line 91 into the pipe line 80 to enhance combustibility of the waste gas. If the content of combustible gases in the waste gas is not so high and an inert gas such as nitrogen or helium is contained in a relatively large amount of the waste gas, the formation of a flame at the burner will become difficult. In case the content of combustible gases in the waste gas is adjusted to at least 70 vol %, the formation of a flame at the burner becomes easy and the "blown-off" phenomenon at the burner can be prevented. The combustion-supporting gas is introduced through a pipe line 92 into the burner. The content of oxygen in the combustion-supporting gas is, as mentioned above, adjusted at least 60 vol % to burn the combustible gas completely. As the waste gas contains microparticles of As or Ga formed by decomposition, such microparticles tend to clog the burner. Thus, a mixture of nitrogen and water is allowed to flow through nozzle of the burner from time to time to wash out any clogging material from the burner without disconnecting the burner. As the clogging material cannot be removed by using nitrogen or water alone, the use of a mixture of nitrogen and water is required for this purpose. Nitrogen is introduced at need into the pipe line 81 for the waste gas, through a pipe line 93, a valve 95 and a pipe line 97. Further, water is supplied through a pipe line 94, a valve 96 and a pipe line 97 to the pipe line 81 for the waste gas so that a mixture of water and nitrogen is allowed to flow, if necessary, through the pipe line 97 in a nozzle of the burner for washing and cleaning of the burner nozzle.

A pipe line 83 for the waste combustion gas between the combustion apparatus 73 and the dust-removing filter device 75 may be connected with a pipe 109' for air having a control valve 109. Air may be introduced through the pipe 109 into the waste combustion gas to dilute it for preventing the dust-removing filter from any clogging. As the waste combustion gas contains mists and moisture-containing microparticles, the individual microparticles captured by the dust-removing filter may be coagulated and bonded by the moisture. Accordingly, air is introduced into the waste combustion gas, prior to sending it to the dust-removing filter 75, whereby the waste combustion gas is diluted with air and simultaneously the moisture contained therein can be evaporated to avoid the problem of clogging. Any conventional filter can be used, so far as it captures the microparticles, for the dust-removing filter 75. The amount of air to be mixed with the waste combustion gas can suitably be adjusted according to the nature of the gas.

The apparatus is provided various sensors capable of checking troubles or abnormal operations in the combustion system, and also with a control unit 100 which, according to the signals from these sensors, can switch the valves 77 and 78 whereby the passageway of the toxic gas normally open to the combustion furnace is closed but the passageway to the adsorption bed tower is opened to introduce the toxic gas thereto so that the detoxicating treatment may continuously be performed.

Among the sensors, a pressure sensor 101 is mounted in the pipe 81 to detect abnormal elevation of the pressure in the pipe; a flame sensor 102 mounted in the furnace portion of the apparatus 73, to detect extinguishment of the flame of the burner; an inflammable gas sensor 104 is mounted in the pipe line 83 to detect the existence of unburned combustible gas in the waste combustion gas, and an optional temperature sensor 103 is mounted in the apparatus to detect abnormal elevation of the temperature in the furnace. The inflammable gas sensor 104 also serves to check whether purge of the apparatus is complete or not at the start of the operation. These sensors are electrically connected to the control unit 100 so that the control unit can open the valve 77 while closing the valve 78 based on the signal from any of the sensors.

A level sensor 105 is provided in the lower portion of the apparatus 73 for actuating a level controller 107 capable of adjusting the valve 106 in the pipe 89 whereby the level of water in the apparatus can be maintained constant. A pressure sensor 108 is provided in the furnace portion of the apparatus 73 and is connected to the pressure control unit 100 for actuating the control valve 109 for the pipe 109' to control the volume of air to be sucked therethrough whereby the inner pressure of the furnace can be maintained at a predetermined value.

As the waste gas from a plant for manufacturing semi-conductors is toxic, the apparatus for the combustion treatment is usually installed near the plant without using a long pipe line for the waste gas to avoid any leakage problem. In this case, variation or fluctuation in pressure of the apparatus is transmitted to an apparatus for manufacturing semi-conductors, and as a result of such variation in pressure, the quality of the semi-conductors is seriously affected. In addition, such variation in pressure adversely affects the operation of the combustion furnace itself and causes incomplete combustion of the toxic gas and, in the extreme case, extinguishment of the flame. In the past, the following three methods have been chiefly adopted to minimize variation in pressure of a combustion furnace: (1) a valve-controlling system for adjusting the volumes of the fluids to/-from a furnace by a valve and (2) the use of a large capacity furnace to absorb variation in pressure, or a combination of these methods. However, these methods have a number of drawbacks in difficulty in operation or cost.

As a small amount of microparticles formed in the course of manufacturing semi-conductors is always contained in the waste gas, such microparticles tend to clog valves or like devices when a pressure control valve or vacuum pump is provided between the plant and the furnace.

In accordance with the present invention, such trouble incidental to the combustion treatment can also be overcome by a simple modification of the apparatus. More precisely, the combustion apparatus can be provided according to this invention with a specific fluctuating-pressure absorber having a buffer space capable of absorbing delicate and short cycle fluctuation in pressure in such manner that the inner pressure of furnace is balanced with the pressure of an external space kept under constant pressure through the buffer space interposed therebetween.

Figure 12:
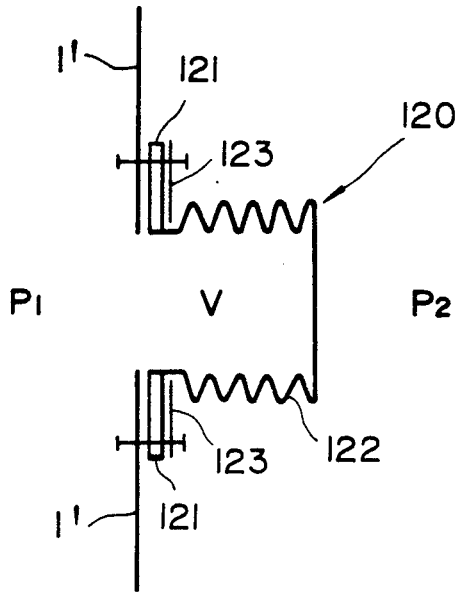
FIG. 12 is an explanatory diagram showing the structure of a buffer space for adjusting the inner pressure of the combustion furnace.

FIG. 12 is an explanatory diagram showing one example of the buffer space used in the fluctuating-pressure absorber. In FIG. 12 showing the basic model of the fluctuating-pressure absorber, the wall 1' of the apparatus has an opening to which the fluctuating-pressure absorber 120 is mounted. In this example, the absorber 120 itself constitutes a buffer space V. This absorber 120 is basically constructed with a supporting member 121 and a flexible material 122 in the form of a one-end-opened box or bag. The buffer space V is connected to the interior space of the furnace but is isolated from the external space with the flexible material 122. The external space may be atmosphere or a space kept under a constant pressure. The pressure $P_1$ in the furnace is fluctuated by the combustion treatment by $\pm\Delta P$ from the design pressure $P_0$ while the pressure $P_2$ of the external space is kept constant. According to one of the ways of operating the fluctuating-pressure absorber 120, elevation of the inner pressure $P_1$ can be absorbed by the absorber 120 in such manner that the capacity of the buffer space V is spread to balance $P_1$ with $P_2$. In FIG. 12, a fixing ring 123 is used to effect sealing between 1' and the supporting member 121. When the inner pressure $P_1$ is reduced during the operation, the buffer space V is allowed to shrink according to the degree of reduction in pressure to balance the inner pressure $P_1$ with the external pressure $P_0$. As the pressure $P_0$ is designed to be almost equal to the external pressure $P_2$ or atmospheric pressure, the buffer space V can be easily be changed in its capacity.

The flexible material 122 is usually shaped to a cylindrical or baggy form and preferably has bellows which can easily change the capacity of the buffer space. The flexible material is preferably made of a rubbery substance such as soft natural rubber, neoprene, nitrile rubber, silicone rubber or fluorinated rubber or of a synthetic resin such as teflon, polyvinyl chloride, polyolefin or polyurethane. The use of a rubbery substance is preferable because of its own elasticity and good elongation. The thickness of the flexible material is desirably 0.05–2 mm. If the thickness is too thin, the material will soon be broken or permit gas permeation. On the other hand, if the thickness is too thick, the material will not move freely in compliance with the fluctuation in pressure.

The supporting member 121 used for connecting the absorber 120 to the apparatus is generally made of a thick panel of a rubber or a plastic material. This material may preferably be made of a packing material such as a silicone rubber packing, etc. These materials can be attached tightly to the wall 1' to afford a sealing between the wall and the absorber.

Figure 13:
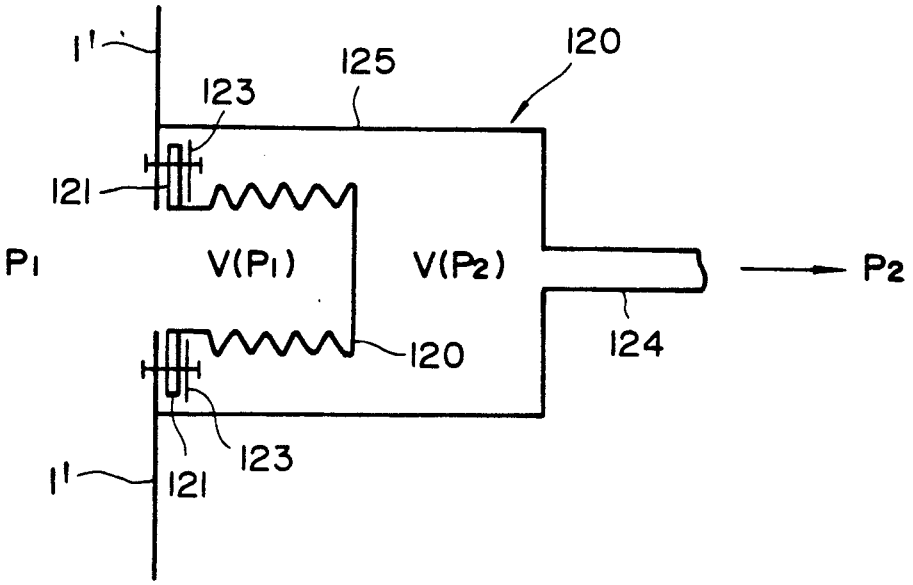
FIG. 13 is an explanatory diagram showing the structure of another buffer space.

FIG. 13 shows another example of the fluctuating-pressure absorber which is a modification of the example shown in FIG. 12. In FIG. 13, the same absorber 120 as shown in FIG. 12 is placed in the interior of a large container with a pipe opened to the exterior. The reference numerals 1' and 120–123 used in FIG. 13 show the same parts as shown in FIG. 12. In FIG. 13, a cylindrical body 125 has a large capacity in which smaller size absorber as shown in FIG. 12 can be placed, and may have or may not have a pipe 124 opened to the exterior. In such double cylinder structure, there are two buffer spaces $V(P_1)$ and $V(P_2)$. This example is preferable if the external pressure $P_2$ is superatmospheric or subatmospheric pressure.

Figure 14:
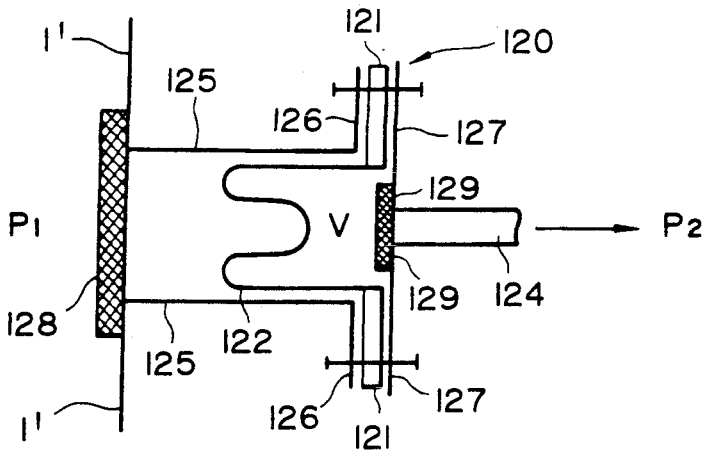
FIG. 14 is an explanatory diagram showing the structure of still another buffer space.

FIG. 14 shows still another example of the fluctuating-pressure absorber 120, wherein a cylindrical body 125 has on its front end a supporting surface 126 onto which a lid 12 having a pipe 124 is fitted. An opening formed on the wall 1' and a small opening formed in the lid 126 are provided with wire nets 128 and 129, respectively. A supporting member 121 is interposed between the supporting surface 126 and the lid 127 to form a tight seal. The lid 127 is provided with a cylindrical body made of a flexible material 122 having a buffur space V inside. The buffer space V communicates with external pressure $P_2$ through the pipe 124. In this example, the net 128 prevents expansion of the flexible material 122 into the furnace beyond it, while the net 129 prevents suction of the flexible material 122 into the pipe 124 beyond it. In case of the absorber 120 shown in FIG. 14, elevation of the inner pressure $P_1$ of the furnace can be absorbed by shrinkage of the capacity of the buffer space V in such manner that the increased inner pressure $P_1$ is transmitted to the flexible material 122 whereby the capacity of the buffer space V is reduced to balance $P_1$ with the external pressure $P_2$. If the inner pressure is reduced, the flexible material is sucked to expand the capacity of the buffer space to balance $P_1$ with $P_2$. The capacity of the buffer space V is determined according to the anticipated fluctuation in inner pressure of the furnace.

Figure 15:
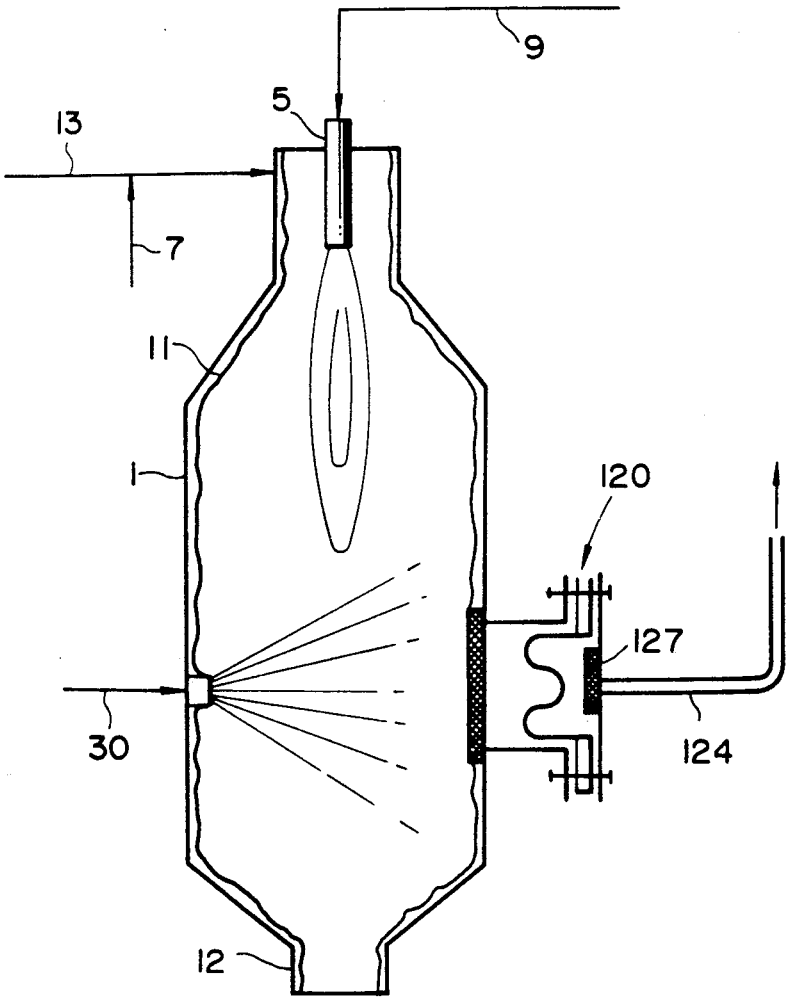
FIG. 15 is an explanatory diagram showing one example of the combustion apparatus provided with the absorber having the buffer space shown in FIG. 14.

FIG. 15 is an explanatory diagram showing one example of the combustion apparatus provided with the fluctuating pressure absorber similar to that shown in FIG. 14. In FIG. 15, the reference numerals used show the same parts as shown in FIGS. 2, 4 and 14, and the combustion treatment can be carried out in the same manner, for example, as described with respect to FIG. 4, without any trouble of fluctuation in pressure.

According to this invention, a combustion treatment of a toxic gas which forms microparticles on combustion can be carried out in a specific furnace where the microparticles formed by combustion can be completely captured with an aqueous film flowing down on the inner surface of the furnace and aqueous droplets formed on a cooled surface or dispersed in the interior space of the furnace. According to a combustion-type apparatus of this invention, capturing and separation of the microparticles can be carried out advantageously in a single unit. In addition, the operation can be carried out without fear of any trouble caused by extinguishment of the flame in the furnace or fluctuation in pressure in the treatment. The apparatus is entirely free from the problem of deposit of the microparticles in the furnace, maintenance of the apparatus is easy and the operation itself can be carried out over a long period of time. Furthermore, the present invention achieves many other technical merits as described hereinbefore, and so brings about a great industrial advantage, especially in the field of treating industrial waste gas or effluent.

The present invention will now be illustrated in more detail by way of Examples and Comparative Example.

EXAMPLE 1

Using the apparatus shown in FIG. 4, a combustion treatment of a toxic gas was carried out. The toxic gas used contained 0.8 vol % of phosphine ($PH_3$), 0.4 vol % of arsine ($AsH_3$) and the balance being hydrogen.

In the apparatus shown in FIG. 4, a mixture of water from the pipe 7 and air from the pipe 13 was jetted from the uppermost part of the combustion furnace in the circumferential direction thereof whereby an aqueous film was formed flowing down on the inner wall of the furnace. Hydrogen was burned at the pilot burner 32 to form a hydrogen flame, and simultaneously water was sprayed from the spray nozzle 30 to disperse aqueous droplets in the interior space of the furnace. Water collected from the bottom of the furnace was recycled, after separating solid microparticles by precipitation, to the pipe 7.

A primary combustion-supporting gas and a secondary combustion-supporting gas were supplied to the pipes 22 and 23, respectively, of the burner while the toxic gas was supplied to the pipe 21 of the burner. These gases flowing out of the main burner were brought into combustion by the aid of the flame of the pilot burner. Water was introduced into the pipe 24 of the main burner, the front end of which had been closed to form a jacket structure whereby a water jacket for cooling the burner was formed. Below are the conditions for the combustion operation.

COMBUSTION CONDITIONS (1) Toxic gas (from the pipe 21)
Flow rate: 12N liters/min.
Linear velocity*: 5 meters/sec.
* STP, based on the remaining gases except steam after combustion (2) Primary combustion-supporting gas (from the pipe 22)
Composition: 100 vol % oxygen
Flow rate: 4N liters/min.
Linear velocity: 0.96 meters/sec.

(3) Secondary combustion-supporting gas (from the pipe 23)
Composition: 100 vol % oxygen
Flow rate: 10N liters/min.
Linear velocity: 1.5 meters/sec.

CONDITIONS FOR FORMING AN AQUEOUS FILM (1) Volumetric amount of water (from the pipe 7): 7 liters/min.

(2) Volumetric amount of air (from the pipe 13): 5N liters/min.

CONDITIONS FOR FORMING AQUEOUS DROPLETS (1) Volumetric amount of water sprayed: 5N liters/-min.

CONDITIONS FOR THE GASES IN THE FURNACE (1) Volumetric amount of non-combustible gas supplied into the furnace: 19N liters/min.

(2) Ratio by volume of the toxic gas to the non-combustible gas: 1.58

(3) Linear velocity of the gases* in the furnace flowing downwards: 0.58 cm/sec.
* STP, based on the remaining gases except steam after combustion

OPERATION CONDITION FOR THE PILOT BURNER (1) Hydrogen
Flow rate: 2.5N liters/min.
Linear velocity: 20 meters/sec.

As a result of the combustion treatment of the toxic gas, phosphine and arsine were not at all detected in the combustion gas discharged from the bottom of furnace. The amount of the microparticles ($P_2O_5$ and $As_2O_3$) contained in the combustion gas was measured. The rate of removal of the microparticles in the furnace was calculated from the above amount and the amount of the resultant microparticles based on the amount of the total toxic gas treated. As a result of the calculation, the rate of removal of $P_2O_5$ and the rate of removal of $As_2O_3$ were 96.5% and 96.2%, respectively.

After completion of the above combustion treatment test (after the lapse of 100 hours from the initiation of the test), the tip of the burner and the inner surface of the furnace were checked as to whether there was a deposit of the microparticles or not. As a result of this checking, no deposit of the microparticles was found.

EXAMPLE 2

A combustion treatment was carried out in the same manner as described in Example 1 except that a mixture of 3 vol % of monosilane ($SiH_4$) and 97 vol % of hydrogen was used as the toxic gas, that a venturi scrubber 38 was used in place of the spray nozzle 30 for spraying the aqueous droplets, and that the combustion treatment of the toxic gas was carried out by supplying hydrogen to the pipe 22 of the burner and supplying air to the pipe 23 thereof. Operating conditions in this case were as follows:

COMBUSTION CONDITION (1) Toxic gas (from the pipe 21)
Flow rate: 10N liters/min.
Linear velocity: 4 meters/sec.
(2) Hydrogen (from the pipe 22)
Flow rate: 5N liters/min.
Linear velocity: 4.8 meters/sec.
(3) Air (from the pipe 23)
Flow rate: 37N liters/min.
Linear velocity: 4.8 meters/sec.

CONDITIONS FOR FORMING AN AQUEOUS FILM (1) Volumetric amount of water (from the pipe 7): 7 liters/min.
(2) Volumetric amount of air (from the pipe 13): 5N liters/min.

CONDITIONS FOR FORMING AQUEOUS DROPLETS

Volumetric amount of water supplied (at the exit on the bottom of the furnace): 15 liters/min.
(1) Volumetric amount of non-combustible gas supplied to the furnace: 42N liters/min.
(2) Ratio by volume of the toxic gas to the non-combustible gas: 4.2
(3) Linear velocity of the gases in the furnance flowing downwards: 1.8 cm/sec.

As a result of the combustion treatment of the toxic gas in the manner above mentioned, it was found that the content of monosilane ($SiH_4$) contained in the combustion gas discharged from the bottom of the furnace was less than 0.5 ppm and that the rate of removal of the microparticles ($SiO_2$) was 90.1%.

EXAMPLE 3

A combustion treatment was carried out in the same manner as described in Example 1 except that a mixture of 3 vol % of phosphine ($PH_3$) and 97 vol % of hydrogen was used as the toxic gas and that the following operation conditions were adopted:

COMBUSTION CONDITION (1) Toxic gas (from the pipe 21)
Flow rate: 21N liters/min.
Linear velocity: 8.75 meters/sec.
(2) Primary combustion-supporting gas (from the pipe 22)
Composition: 100 vol % oxygen
Flow rate: 4N liters/min.
Linear velocity: 0.9 meters/sec.
(3) Secondary combustion-supporting gas (from the pipe 23)
Composition: 100 vol % oxygen
Flow rate: 10N liters/min.
Linear velocity: 1.5 meters/min.

CONDITIONS FOR THE GASES IN THE FURNACE (1) Volumetric amount of non-combustible gas supplied into the furnace: 19N liters/min.
(2) Ratio by volume of the toxic gas to the non-combustible gas: 0.9
(3) Linear velocity of the gases in the furnace: 0.40 cm/sec.

As a result of the combustion treatment of the toxic gas in the manner as above mentioned, it was found that phosphine was not all detected in the waste combustion gas discharged from the bottom of the furnace and that the rate of removal of $P_2O_5$ calculated from the result of measurement of the concentration of $P_2O_5$ in the waste combustion gas was 99.0%.

EXAMPLE 4

Using the apparatus shown in FIG. 6, the combustion treatment of a toxic gas was carried out. The toxic gas used contained 5 vol % of phosphine, 1 vol % of arsine and the balance being hydrogen.

In the apparatus shown in FIG. 6, chilled water was introduced into the hollow space 11'' of the furnace to form a water-cooled jacket and discharged therefrom through the pipe 8, whereby a cooled surface was formed on the inner wall of the furnace. Hydrogen was burned at a pilot burner (not shown in the drawing) to form a hydrogen flame, and simultaneously water was sprayed from the spray nozzle 30 to disperse aqueous droplets in the interior space of the furnace.

A primary combustion-supporting gas and a secondary combustion-supporting gas were supplied to the pipes 22 and 23, respectively, of the burner while the toxic gas was supplied to the pipe 21 of the burner. These gases flowing out of the main burner were combusted by the aid of the flame of the pilot burner. Water was introduced into the pipe 24 of the main burner, the front end of which had been closed to form a jacket structure whereby a water jacket for cooling the burner was formed. Below are the conditions for the combustion operation.

COMBUSTION CONDITIONS (1) Toxic gas (from the pipe 21)
Flow rate: 12N liters/min.
Linear velocity: 5 meters/sec.
(2) Primary combustion-supporting gas (from the pipe 22)
Composition: 100 vol % oxygen Flow rate: 6N liters/min.
Linear velocity: 1.4 meters/sec.

(3) Secondary combustion-supporting gas (from the pipe 23)
Composition: 100 vol % oxygen
Flow rate: 10N liters/min.
Linear velocity: 1.5 meters/sec.

CONDITION FOR FORMING THE COOLING SURFACE (1) Volumetric amount of water (from the pipe 8): 20 liters/min.

CONDITION FOR FORMING AQUEOUS DROPLETS (1) Volumetric amount of water sprayed (from the spray nozzle 30): 12 liters/min.

CONDITIONS FOR THE GASES IN THE FURNACE (1) Volumetric amount of non-combustible gas supplied into the furnace (the primary combustion-supporting gas plus the secondary combustion-supporting gas): 16N liters/min.

(2) Ratio by volume of the toxic waste gas to the non-combustible gas: about 1.3

(3) Linear velocity of the gases in the furnace flowing downwards*: 0.58 cm/sec.

* based on the remaining gases after combustion except steam

As a result of the combustion treatment of the toxic gas, phosphine and arsine were not at all detected in the combustion gas discharged from the bottom of furnace. The amount of the microparticles ($P_2O_5$, $As_2O_5$, etc,) contained in the combustion gas was measured. The rate of removal of the microparticles in the furnace was calculated from the above amount and the amount of the resultant microparticles based on the amount of the total toxic gas treated. As a result of the calculation, the rate of removal of $P_2O_5$ and the rate of removal of $As_2O_5$ were 98.3% and 96.9%, respectively.

COMPARATIVE EXAMPLE 1

A combustion treatment was carried out in the same manner as described in Example 4 except that 50N liters/min. of air was used as the second combustion-supporting gas in place of 10N liters/min. of 100 vol % of oxygen and that the ratio by volume of the toxic gas to the non-combustible gas was 4.7. In this case, phosphine and arsine were detected in amounts of 3 ppm and 0.5 ppm, respectively, in the waste combustion gas discharged from the bottom of the furnace. The rate of removal of $As_2O_3$ and $P_2O_3$ were decreased to 92.5% and 93.1%, respectively.

EXAMPLE 5

A combustion treatment was carried out in the same manner as described in Example 4 except that a mixture of 3 vol % of phosphine ($PH_3$) and 97 vol % of hydrogen was used as the toxic gas and the following operation conditions were employed.

COMBUSTION CONDITIONS (1) Toxic gas (from the pipe 21)
Flow rate: 21N liters/min.
Linear velocity: 8.75 meters/sec.

(2) Primary combustion-supporting gas (from the pipe 22)
Composition: 100 vol % oxygen
Flow rate: 4N liters/min.
Linear velocity: 0.9 meters/sec.

(3) Secondary combustion-supporting gas (from the pipe 23)
Composition: 100 vol % oxygen
Flow rate: 10N liters/min.
Linear velocity: 1.5 meters/sec.

CONDITIONS FOR THE GASES IN THE FURNACE (1) Volumetric amount of the non-combustible gas supplied into the furnace (the primary and secondary combustion-supporting gases): 14N liters/min.

(2) Ratio by volume of the toxic gas to the non-combustible gas: about 0.7

(3) Linear velocity of the gases in the furnace: 0.33 cm/sec.

As a result of the combustion treatment carried out as above, phosphine was not detected in the waste combustion gas discharged from the bottom of the furnace. The rate of removal of $P_2O_5$ calculated from the measurement of the $P_2O_5$ in the waste combustion gas was 99.1%.

EXAMPLE 6

A combustion treatment was carried out in the same manner as described in Example 4 except that a mixture of 5 vol % of phosphine ($PH_3$) and 95 vol % of hydrogen was used as the toxic gas and the following operation conditions were employed.

COMBUSTION CONDITIONS (1) Toxic gas (from the pipe 21)
Flow rate: 12N liters/min.

(2) Primary combustion-supporting gas (from the pipe 22)
Composition: 100 vol % oxygen
Flow rate: 4N liters/min.

(3) Secondary combustion-supporting gas (from the pipe 23)
Composition: air
Flow rate: 16N liters/min.

CONDITIONS FOR THE GASES IN THE FURNACE (1) Volumetric amount of the non-combustible gas supplied into the furnace (the primary and secondary combustion-supporting gases plus ventilating gas): 16N liters/min.

(2) Ratio by volume of the toxic gas to the non-combustible gas: 1.7

(3) Linear velocity of the gases in the furnace: 0.81 cm/sec.

As a result of the combustion treatment carried out as above, phosphine was not detected in the waste combustion gas.

COMPARATIVE EXAMPLE 2

A combustion treatment was carried out in the same manner as described in Example 6 except that 10N liters/min. of air and 35N liters/min. of air were supplied to the pipes 22 and 23 of the burner. As a result of the combustion treatment, 12 ppm of phosphine was detected in the waste combustion gas. The ratio by volume of the toxic gas to the non-combustion gas was 3.8.

EXAMPLE 7

Using the apparatus shown in FIG. 7, a combustion treatment of a toxic gas was carried out. The toxic gas used contained 5 vol % of phosphine ($PH_3$) and 95 vol % of hydrogen.

In the apparatus shown in FIG. 7, a mixture of water from the pipe 56 and air from the pipe 59 was jetted from the uppermost part of the combustion furnace (A) in the circumferential direction thereof whereby an aqueous film flowing downwards was formed on the inner wall of the furnace. Hydrogen was burned at the pilot burner 32 to form a hydrogen flame, and simultaneously water was sprayed from the spray nozzle 30 to disperse aqueous droplets in the interior space of the furnace (A). Water in the liquid pool 43 of the gas-liquid separator (B) was recycled, as shown in FIG. 7, to the pipe 58 for repeated use. In the separator (B), the packing-filled bed 45 was formed of a supporting member in upside-down conical form filled with wiremesh (mesh: 48, size: 15 mm) in the form of a saddle and was fixed to the body 41.

A primary combustion-supporting gas and a secondary combustion-supporting gas were supplied to the pipes 22 and 23, respectively of the diffusion-type burner 5 (FIG. 3(*b*)) while the toxic gas was supplied to the pipe 21 of the burner. These gases flowing out of the main burner were combusted by the aid of the hydrogen flame of the pilot burner. Water was concurrently introduced into the pipe 23 of the main burner, the front end of which had been closed to form a double-wall structure with a hollow space whereby a water jacket for cooling the burner was formed. Below are the conditions for the combustion operation.

COMBUSTION CONDITIONS (1) Toxic gas (from the pipe 15, the pipe 21 in the burner)
Flow rate: 12N liters/min.

(2) Primary combustion-supporting gas (from the pipe 22)
Composition: 100 vol % hydrogen
Flow rate: 6N liters/min.

(3) Secondary combustion-supporting gas (from the pipe 23)
Composition: 100 vol % oxygen
Flow rate: 10N. liters/min.

CONDITIONS FOR FORMING AN AQUEOUS FILM (1) Volumetric amount of water recycled (from the pipe 56): 7 liters/min.

(2) Volumetric amount of water (from the pipe 59): 5 liters/min.

CONDITIONS FOR FORMING AQUEOUS DROPLETS (1) Volumetric amount of water sprayed (from the spray nozzles 30): 19 liters/min.

OPERATION CONDITIONS FOR THE PILOT BURNER (1) Hydrogen
Flow rate: 2.5N liters/min.
Volumetric amount of air: 2.5N liters/min.

As a result of the combustion treatment carried out as above, phosphine was not at all detected (less than 1 ppm) in the combustion gas discharged from the pipe 42. The amount of the microparticles ($P_2O_5$) contained in the combustion gas was measured. The rate of removal of $P_2O_5$ in the apparatus was calculated from the above amount and the amount of the resultant microparticles based on the amount of the toxic gas treated. As a result of the calculation, the rate of removal of $P_2O_5$ was 98.6%.

After completion of the above combustion treatment test (after the lapse of 100 hours from the initiation of the test), the tip of the burner and the inner surface of the furnace were checked as to whether there was deposit of the microparticles or not. As a result of this checking, no deposit of the microparticles was found.

EXAMPLE 8

A combustion treatment of a toxic gas was carried out in the same manner as described in Example 7 except that a mixture of 5 vol % of monosilane ($SiH_4$) and 95 vol % of hydrogen was used as the toxic gas and that the volumetric amount of air from the pipe 59 was adjusted to 40 liters/min. As a result of the combustion treatment, it was found that no monosilane was detected in the combustion gas discharged from the pipe 42. The rate of removal of $SiO_2$ was 93.4%.

EXAMPLE 9

A combustion treatment of a toxic gas was carried out in the same manner as described in Example 7 except that a mixture of 2 vol % of arsine ($AsH_3$) and 98 vol % of hydrogen was used as the toxic gas and 3 volumetric amount of air from the pipe 59 was 5 liters/min. As a result of the combustion treatment, it was found that no arsine was detected (less than 4 ppb) in the combustion gas discharged from the exhaust pipe 42. The rate of removal of the microparticles ($As_2O_3$) in the apparatus was 98.1%.

EXAMPLE 10

A combustion treatment of the toxic gas was carried out in the same manner as described in Example 7 except that the volumetric amount of air from the pipe 59 was adjusted to 40 liters. As result of the combustion treatment, no phosphine was detected also in this case in the combustion gas discharged from the exhaust pipe 42. The rate of removal of the microparticles ($P_2O_3$) in the apparatus was 96.6%.

EXAMPLE 11

A combustion treatment of the toxic gas was carried out in the same manner as described in Example 10 except that the packing-filled bed was not used. As a result of the combustion treatment, no phosphine at all was detected in the combustion gas discharged from the exhaust pipe 22. The rate of removal of the microparticles ($P_2O_5$) in the apparatus was 90.8%.

EXAMPLE 12

Using the combustion furnace as shown in FIG. 15, a combustion treatment was carried out under a specifically controlled condition wherein the inner pressure in the treatment of a mixture of 5 vol % of phosphine and 95 vol % of hydrogen deemed as a waste gas from a plant for manufacturing semi-conductors may become equal to atmospheric pressure. In this case, a soft natural rubber sheet was used as the flexible material 122 and the supporting member 121 of the fluctuating-pressure absorber 120 shown in FIG. 14, and the connecting pipe 124 was opened to atmosphere to balance the inner pressure of the furnace with atmospheric pressure.

In this combustion treatment, phosphine was not at all detected in the waste combustion gas. Fluctuation in pressure observed was ±8 $mmH_2O$ in the interior space of the furnace, ±4 $mmH_2O$ at the inlet of the burner, thus showing extremely minimized fluctuation in pressure. Phosphine was not at all detected in the waste combustion gas.

EXAMPLE 13

A combustion treatment of the toxic gas was carried out in the same manner as described in Example 12 except that neoprene rubber was used as the flexible material 122 and the supporting member 121. Fluctuation in pressure observed was ±10 $mmH_2O$ in the interior space of the furnace and ±5 $mmH_2O$ at the inlet of the burner. Phosphine was not at all detected in the waste combustion gas.

EXAMPLE 14

A combustion treatment of the toxic gas was carried out in the same manner as described in Example 12 except that under the combustion condition set as −70 $mmH_2O$ as the inner pressure, the front end of the connecting pipe 124 in the fluctuating-pressure absorber is connected to a scrubber for exhaust gas operated at −70 $mmH_2O$. In this combustion treatment, phosphine was not at all detected in the waste combustion gas. Fluctuation in pressure observed was ±10 $mmH_2O$ (i.e. −60 to −80 $mmH_2O$) and ±5 $mmH_2O$ at the inlet of the burner. Fluctuation in pressure in the scrubber itself was ±1-2 $mmH_2O$.

COMPARATIVE EXAMPLE 3

A combustion treatment of the toxic gas was carried out in the same manner as described in Example 12 except that the fluctuating-pressure absorber was not used. In this combustion treatment, phosphine was not at all detected in the waste combustion gas. However, fluctuation in pressure was significant and as high as ±50 $mmH_2O$ in the furnace and in the inlet of the burner.

It is understood that the preceding representative examples may be varied within the scope of the present specification both as to the methods and the operation conditions, by one skilled in the art to achieve essentially the same results.

As many widely different embodiments of this invention may be made without departing from the spirit and scope thereof, it is to be construed that this invention is not limited to the specific embodiments thereof except as defined in the appended claims.

What is claimed is:

1. A method for the combustion treatment of a toxic gas which forms microparticles by combustion, said method comprising:

providing a combustion chamber having a cylindrical interior surface with a top rim and a bottom rim; a top joined to said top rim and a bottom joined to said bottom rim to close the combustion chamber; a burner nozzle extending into said combustion chamber; at least one water inlet; and an outlet;

forming a downwardly flowing film of aqueous liquid over the whole of said cylindrical surface, from said top rim to said bottom rim; and passing the toxic gas through the burner nozzle and burning said toxic gas as it exits the burner nozzle to form the microparticles and a combustion gas, said microparticles and combustion gas having a linear velocity toward the outlet less than 0.05 meter/second to provide a residence time of the microparticles within said combustion chamber sufficiently long that said microparticles are captured within said combustion chamber by the aqueous liquid and removed from the combustion chamber through the outlet.

2. The method of claim 1 additionally comprising forming a water film on the surface of the burner nozzle.

3. The method of claim 2 further comprising forming a water film covering the top and the bottom of the combustion chamber.

4. The method of claim 2 wherein said microparticles are solid oxides.

5. The method of claim 1 further comprising forming a water film covering the top and the bottom of the combustion chamber.

6. The method of claim 1 further comprising passing an oxygen-containing gas through the burner nozzle, the burner nozzle having separate conduits for the toxic gas and the oxygen-containing gas whereby the toxic gas and oxygen-containing gas are prevented from mixing prior to exit from the burner nozzle.

7. The method of claim 1 further comprising injecting an aqueous spray into said combustion chamber transverse to the flow of said microparticles and combustion gas to cool the combustion gas within the combustion chamber and to capture a portion of the microparticles in the spray.

8. The method of claim 6 wherein said oxygen-containing gas contains at least 60% by volume oxygen and is introduced into the combustion chamber at a rate serving to maintain the amount of inflammable gases in the combustion gas within the combustion chamber at less than 4 volumetric parts per volumetric part of toxic gas introduced.

9. The method according to claim 8, wherein the oxygen-containing gas has an oxygen content of 100%.

10. A method according to claim 1, wherein the toxic gas is introduced into the combustion chamber through a backfire preventing device and a first valve in a pipe and wherein an adsorption tower is connected to the pipe through a second valve, and the toxic gas is normally supplied to the combustion chamber by opening the first valve while keeping the second valve closed, but the toxic gas is routed to the adsorption tower by opening the second valve while keeping the first valve closed responsive to any abnormal increase of the pressure across a system serving as a source of the toxic gas, responsive to extinguishment of the flame at the burner nozzle and responsive to detection of any inflammable gas in the gas discharged through the outlet.

11. A method according to claim 1, wherein the pressure within the combustion chamber is balanced with a constant pressure exterior to the combustion chamber by a buffer having a flexible material separating the combustion chamber from the exterior at said constant pressure, the volume of the buffer changing to absorb any variation in pressure within the combustion furnace.

12. A method according to claim 11, wherein the exterior is open air.

13. A method according to claim 11, wherein the exterior is a space at superatmosphereic or subatmospheric pressure.

14. A method for the combustion treatment of a toxic gas which forms microparticles by combustion, said method comprising:

providing a combustion chamber having a cylindrical interior surface with a top rim and a bottom rim; a top joined to said top rim and a bottom joined to said bottom rim to close the combustion chamber; a burner nozzle having a plurality of separate gas passage and extending into said combustion chamber; at least one water inlet; and an outlet;

passing the toxic gas through at least one of the gas passages in the burner nozzle and burning said toxic gas as it exits the burner nozzle to form the microparticles and a combustion gas containing steam;

cooling said interior surface to condense said steam, thereby forming a downwardly flowing film of aqueous liquid over the whole of said cylindrical surface, from said top rim to said bottom rim, whereby a portion of the microparticles are captured by the water film;

spraying an aqueous liquid into the combustion chamber transverse to the flow of said microparticles and combustion gas to capture an additional portion of the microparticles in the spray;

feeding a combustion-supporting gas through at least a second of the gas passages in the burner nozzle, wherein said cpmbustion-supporting gas contains at least 60% by volume oxygen, and wherein said combustion gas and said microparticles have a linear velocity toward the outlet of less than 0.05 meter/second to provide a residence time of the microparticles within said combustion chamber sufficiently long that they are completely captured within said combustion chamber by the aqueous liquids, and wherein the amount of non-inflammable gas in the combustion gas is less than 4 volumetric parts per volumetric part of toxic gas introduced.

15. The method of claim 14 wherein said cooling is effected by circulating a coolant through a jacket provided around the combustion chamber.

16. A method for the combustion treatment of a toxic gas which forms microparticles by combustion, said method comprising:

providing a combustion chamber having a cylindrical interior surface with a top rim and a bottom rim; a top joined to said top rim a gas-liquid separator joined to said bottom rim to close the combustion chamber; a burner nozzle extending into said combustion chamber; and at least one water inlet;

passing the toxic gas through the burner nozzle and burning said toxic gas as it exits the burner nozzle to form the microparticles and a combustion gas;

forming a downwardly flowing film of aqueous liquid over the whole of said cylindrical surface, form said top rim to said bottom rim, to capture a portion of the microparticles in the water film;

spraying an aqueous liquid into said combustion chamber transverse to the flow of said microparticles and combustion gas to capture an additional portion of the microparticles in the spray;

discharging the combustion gas and aqueous liquid from the combustion chamber through said gas-liquid separator; and passing the toxic gas through the burner nozzle and burning said toxic gas as it exits the burner nozzle to form the microparticles and a combustion gas, said microparticles and combustion gas having a linear speed toward the outlet less than 0.05 meter/second, to provide a residence time of the microparticles within said combustion chamber sufficiently long that they are captured within said combustion chamber by the aqueous liquids and removed from the combustion chamber through the outlet.

17. A method according to claim 16, wherein the gas-liquid separator includes a packed bed containing pieces of a wire mesh of 10–100 mesh size and wherein said combustion gas and aqueous liquid is discharged first through said packed bed then subjected to gas-liquid separation.

18. A method according to claim 16, wherein the aqueous liquid is separated from the combustion gas in the gas-liquid separator and is recycled to the combustion furnace and used therein to form the aqueous liquid film and the aqueous liquid spray.

19. A method according to claim 16, wherein the toxic gas is introduced into the combustion chamber through a backfire preventing device and a first valve in a pipe and wherein an adsorption tower communicates with the pipe through a second valve, and the toxic gas is normally supplied to the combustion chamber by opening the first valve while keeping the second valve closed, but the toxic gas is routed to the adsorption tower by opening the second valve while keeping the first valve closed responsive to any abnormal increase of the pressure across a system serving as a source of the toxic gas, responsive to extinguishment of the flame at the burner nozzle and responsive to detection of any inflammable gas in the gas discharged through the outlet.

20. A method according to claim 16, wherein the pressure within the combustion chamber is balanced with a constant pressure exterior to the combustion chamber by a buffer having a flexible material separating the combustion chamber from the exterior at said constant pressure, the volume of the buffer changing to absorb any variation in pressure within the combustion furnace.

21. A method according to claim 20, wherein the exterior is open air.

22. A method according to claim 20, wherein the exterior is a space at superatmospheric or subatmospheric pressure.

* * * * *